US005455139A

United States Patent [19]

Wada et al.

[11] Patent Number: 5,455,139

[45] Date of Patent: Oct. 3, 1995

[54] LIGHT-SENSITIVE SILVER HALIDE PHOTOGRAPHIC MATERIAL HAVING HIGH SENSITIVITY AND HIGH SHARPNESS

[75] Inventors: Yasunori Wada; Masaaki Taguchi; Haruhiko Sakuma, all of Hino, Japan

[73] Assignee: Konica Corporation, Japan

[21] Appl. No.: 340,797

[22] Filed: Nov. 16, 1994

Related U.S. Application Data

[63] Continuation of Ser. No. 124,573, Sep. 20, 1993, abandoned, which is a continuation of Ser. No. 899,456, Jun. 16, 1992, abandoned, which is a continuation-in-part of Ser. No. 644,087, Jan. 22, 1991, abandoned.

[30] Foreign Application Priority Data

Jan. 23, 1990 [JP] Japan ..... 2-14561

[51] Int. Cl.[6] ..... G03C 5/17

[52] U.S. Cl. ..... 430/139; 430/502; 430/509; 430/966

[58] Field of Search ..... 430/139, 502, 430/509, 966

[56] References Cited

U.S. PATENT DOCUMENTS 4,994,355 2/1991 Dickerson et al. ..... 430/509

4,997,750 3/1991 Dickerson et al. ..... 430/509

5,021,327 6/1991 Bunch et al. ..... 430/502

OTHER PUBLICATIONS

Research Disclosure 308119, Dec. 1989.

*Primary Examiner*—Janet C. Baxter

*Attorney, Agent, or Firm*—Jordan B. Bierman; Bierman and Muserlian

[57] ABSTRACT

Disclosed is a light-sensitive silver halide photographic material comprising a support having a first face and a second face, a first photographic component layer being provided on the first face and a second photographic component layer being provided on the second face, each of the first and second component layer comprising a silver halide emulsion layer, wherein; when an exposure dose at a position on the first face is an exposure dose giving a density of a fog density +1.60 after exposing from the first face side and developing the material, a density at a position on the second face corresponding to the position on the first face is fog + 0.20 or less, and an amount of a light which transmitted through the first component layer and the support and reaching an interface between the support and the second component layer is 12 to 75% of a light to which the first face side of the material is exposed.

8 Claims, 6 Drawing Sheets

FIG. 1(a')
PRIOR ART

LIGHT-SENSITIVE SILVER HALIDE PHOTOGRAPHIC MATERIAL HAVING HIGH SENSITIVITY AND HIGH SHARPNESS

This application is a continuation of application Ser. No. 08/124573, filed Sep. 20, 1993, now abandoned, which is a continuation of application Ser. No. 07/899456, filed Jun. 16, 1992, now abandoned, which is a continuation-in-part application of application Ser. No. 644,087, filed Jan. 22, 1991, now abandoned.

BACKGROUND OF THE INVENTION

This invention relates to a light-sensitive silver halide photographic material having high sensitivity and also excellent in sharpness of images, and an image-forming method and a photographing method of the same.

In general, films for X-ray photography utilized in medical diagnoses are employed in combination with X-ray fluorescent intensifying screens at the time of photographing. This is because in consideration of influence of X-rays to human bodies, X-rays which have been transmitted through a front X-ray fluorescent intensifying screen are to be further utilized in a rear X-ray fluorescent intensifying screen for the purpose of utilizing X-rays effectively.

In recent years, sensitivities of films and X-ray fluorescent intensifying screens have become higher, and also a higher quality of images for medical diagnoses has been demanded increasingly. Particularly, for observing conditions of focuses or diseased parts more precisely, improvement in sharpness has been strongly demanded.

However, in a light-sensitive silver halide photographic material for X-rays having an emulsion coated on both surfaces, a light irradiated from one X-ray fluorescent intensifying screen is transmitted through an adjacent silver halide emulsion layer, and the light is scattered by a support to cause from both surfaces a so-called crossover exposure phenomenon that a silver halide emulsion layer on the other side is subjected to imagewise exposure, which becomes a great factor to deteriorate sharpness of images.

For reducing a crossover exposure from both surfaces and improving sharpness, there have been made many proposals as disclosed in Japanese Unexamined Patent Publication No. 132945/1986 or U.K. Patent No. 821,352 in which a dye is used in a silver halide emulsion layer or a constituent layer.

Further, improvement has been made not only in films but also in X-ray fluorescent intensifying screens, and, for example, Japanese Unexamined Patent Publication No. 110538/1990 discloses a technique in which silver halide emulsion layers having different color sensitivities are provided on an A surface and a B surface, and X-ray fluorescent intensifying screens having emission spectra corresponding to the respective color sensitivities are used.

However, even in these improved techniques, as long as two sheets of X-ray fluorescent intensifying screens are used on both surface emulsions, deterioration of sharpness cannot be avoided, and particularly, in X-ray photography system, oblique photography in which X-rays are incident obliquely relative to a film surface cause slippage of images of both surfaces, which results in significant deterioration of sharpness.

Also, for improving sharpness, there has been made an attempt that an emulsion layer is provided only on one surface and exposure is effected only from one side. However, there are inconveniences that a sensitivity is low, and that when a sensitivity at one side is to be made higher, a film thickness of a light-sensitive emulsion layer will be increased as a matter of course, and fixing property, washing property or drying rate at one side is lowered, whereby color leftover and deterioration of images due to residual silver and residual hypo are brought about undesirably.

The present inventors have investigated variously a method for improving sharpness of a light-sensitive silver halide photographic material having a silver halide emulsion layer on both surfaces by making sensitivities and amounts of silver coated different between an emulsion layer at one side (A surface) and an emulsion layer at the other side (B surface) and using a X-ray fluorescent intensifying screen only at one surface, and consequently found that since the (A) surface and the (B) surface are composed of different emulsions, amounts of silver and amounts of a binder, respectively, surface physical properties of the (A) and (B) surfaces of a film are not balanced.

For example, when the (A) surface and the (B) surface have different amounts of a binder mainly composed of gelatin and amounts of silver, respectively, tensile strengths of film surfaces become different, whereby undesirable phenomena that a film is curled, and that when control of water contents of the both surfaces is insufficient, films are adhered to each other are observed.

In recent years, photographing systems of X-ray films have been automated, and automatic film conveying property has become one of the most important performances. Under this situation, since curling and adhesion of the film are serious defects, improvement has been demanded urgently Further, it is extremely difficult to distinguish between a front surface and a rear surface of a film having an emulsion layer on both surfaces and to handle it in darkrooms, and generally, there is a great possibility of mistakes.

This is one reason why a film having a front surface and a rear surface with different characteristics has not been employed so far. Therefore, it is required urgently to accomplish a system in which photography can be conducted without using a front surface and a rear surface reversely by mistake when a film having a front surface and a rear surface with different characteristics is used.

SUMMARY OF THE INVENTION

Accordingly, a first object of the present invention is to provide a light-sensitive silver halide photographic material having high sensitivity and also excellent in sharpness.

A second object of the present invention is to provide a light-sensitive silver halide photographic material for X-rays by which images can be obtained without slippage of images even in oblique photographing, and an image-forming method of the same.

A third object of the present invention is to provide a light-sensitive silver halide photographic material for X-rays having good film conveying property.

A fourth object of the present invention is to provide an image-forming method of a light-sensitive silver halide photographic material, in which a X-ray fluorescent intensifying screen is used only on one surface and exposure is effected only from one surface to obtain images with high sharpness when the light-sensitive material according to the present invention is exposed.

A fifth object of the present invention is to provide a photographing method which can facilitate distinction between a front surface and a rear surface of a film and prevent erroneous loading when the film according to the present invention is inserted into a cassette.

The present inventors investigated intensively, and consequently found that these objects can be accomplished by the following material and methods, to accomplish the present invention.

That is, the objects of the present invention can be accomplished by (1) A light-sensitive silver halide photographic material comprising a support having a first face and a second face, a first component layer on said first face and a second component layer on said second face, said first component layer comprising a first silver halide emulsion layer and said second component layer comprising a second silver halide emulsion layer, wherein an exposure dose at a first position on said first component layer which provides, on development, a density of fog density+1.60 also provides, on development, a density of fog density+0.20 or less at a second position on said second component layer and corresponding to said first position, an amount of light which is transmitted through said first component layer and said support and reaching an interface between said support and said second component layer is 12% to 75% of a light to which said first component layer is exposed.

Developing processing conditions (Automatic processor)

Processing is carried out by using SRX 501 (trade name, produced by KONICA CORPORATION) with 45 seconds processing mode. A temperature of the developing processing solution is 35° C. and that of the fixing solution is 33° C. Also, water for washing is supplied with 4 liters per minute and a water temperature of 18° C. A drying temperature is 45° C. Atmosphere in which the automatic processor is installed is 25° C. and 60% relative humidity.

| (Developing solution recipe) | |
|---|---|
| Part - A (for 38 liters finishing) | |
| Potassium hydroxide | 1140 g |
| Potassium sulfite | 2280 g |
| Sodium hydrogen carbonate | 266 g |
| Boric acid | 38 g |
| Diethylene glycol | 418 g |
| Ethylenediaminetetraacetic acid | 61 g |
| 5-Methylbenzotriazole | 1.9 g |
| Hydroquinone | 1064 g |
| Made up to 9.3 liters with addition of water. | |
| Part - B (for 38 liters finishing) | |
| Glacial acetic acid | 418 g |
| Triethylene glycol | 418 g |
| 1-Phenyl-3-pyrazolidone | 100 g |
| 5-Nitroindazole | 9.5 g |
| Made up to one liter with addition of water. | |
| Part - C (for 38 liters finishing) | |
| Glutaraldehyde (50 wt/wt %) | 304 g |
| Sodium metabisulfite | 389 g |
| Made up to 770 ml with addition of water. | |
| Starter | |
| Glacial acetic acid | 230 g |
| Potassium bromide | 200 g |
| Made up to 1.5 liters with addition of water. | |

(Developing solution preparing method)

In a replenishing solution stock tank is charged 20 liters of water with a water temperature of 18° C. and under stirring, the above Part-A, Part-B and Part-C are successively added thereinto to make 38 liters of a solution having a pH of 10.53 at 25° C. After allowing this developing replenishing solution to stand at 25° C. for 24 hours, the above starter is added to the solution with an amount of 20 ml per liter and the mixture is filled in a developing tank of the automatic processor available from KONICA CORPORATION. A pH of the developing solution at this time is 10.26 at 25° C.

The developing replenishing solution was replenished with an amount of 365 ml per 1 $m^2$ of a sample of the present invention.

| (Fixing solution recipe) | |
|---|---|
| Part - A (for 38 liters finishing) | |
| Ammonium thiosulfate | 6080 g |
| Disodium ethylenediaminetetraacetate dihydrate | 0.76 g |
| Sodium sulfite | 456 g |
| Boric acid | 266 g |
| Sodium hydroxide | 190 g |
| Glacial acetic acid | 380 g |
| Made up to 9.5 liters with addition of water. | |
| Part - B (for 38 liters finishing) | |
| Aluminum sulfate (in terms of anhydride) | 570 g |
| Sulfuric acid (50 wt %) | 228 g |
| Made up to 1.9 liters with addition of water. | |

(Fixing solution preparing method)

In a replenishing solution stock tank is charged 20 liters of water with a water temperature of 18° C. and under stirring, the above Part-A and Part-B are successively added thereinto. Finally, water and acetic acid are added to make 38 liters of a solution having a pH of 4.20 at 25° C. After allowing this fixing replenishing solution to stand at 25° C. for 24 hours, it is filled in a fixing tank of the automatic processor available from KONICA CORPORATION. A replenishing amount of the fixing replenishing solution is 640 ml per 1 $m^2$ of a sample of the present invention.

(2) The material of above (1) wherein said first emulsion layer has a sensitivity higher than that of said second emulsion layer.

(3) The material of above (2) wherein a sensitivity of said first emulsion layer is 1.5 to 10 times a sensitivity of said second emulsion layer.

(4) The material of above (2) wherein an amount of silver of said emulsion layer is 1.1 to 5.0 times that of an amount of silver in said second emulsion layer.

(5) The material of above (1) wherein silver halide grains having grain sizes of 0.50 to 2.00 μm occupy at least 50% of a projected area of total silver halide grains in said first emulsion layer.

(6) The material of above (1) wherein normal crystalline monodispersed grains or twin tabular grains having an aspect ratio of at least 5 occupy at least 60% of a projected area of total silver halide grains in said first emulsion layer.

(7) The material of above (3) wherein a first value which is a weight ratio of silver to gelatin of said first emulsion layer is larger than a second value which is a weight ratio of silver to gelatin of said second emulsion layer.

(8) The material of above (7) wherein said first component layer and said second component layer comprise a polyvalent alcohol compound in an amount of $5.0\times10^{-5}$ to $5\times10^{-3}$ mol per gram of said gelatin.

(9) A method of forming an image on a light-sensitive silver halide photographic material comprising a support having a first face and a second face, a first component layer on said first face and a second component layer on said second face, said first component layer comprising a first silver halide emulsion layer and said second component layer comprising a second silver halide emulsion layer, said method comprising exposure, at a first position on said first component layer to light of wavelength of at least 300 nm and development of said material, an exposure dose of said light on said first component layer providing a density of fog density+1.60 after said exposure and said development, said dose also providing, at a second position on said second component layer corresponding to said first position, a density of fog density+0.20 or less, after said exposure and said development, and an amount of said light which is transmitted through said first component layer and said support and reaching an interface between said support and said second component layer is 12% to 75% of said light.

DESCRIPTION OF THE PREFERRED EMBODIMENTS

Figure 1A:
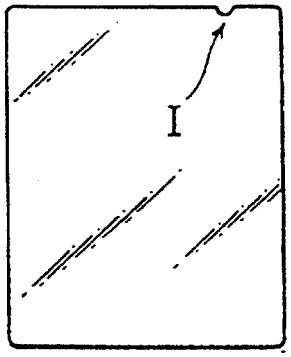
FIG. 1(a) PRIOR ART
FIG. 1 shows plane views of a conventional film (a) with 10× 12 inch size and a conventional cassette (a') for said film for comparison.

In the following, the present invention is explained in more detail.

In the prior art, in films having substantially the same emulsion layer on both surfaces of a support, when an image is observed, a combination of a front surface image directly seen with eyes and a rear surface image seen with eyes through a support base is to be seen.

X-ray photography is generally so conducted that an incident angle of X-rays relative to a film surface is 90° . However, X-ray photography is sometimes conducted at an oblique incident angle. In this case, the "slippage" of the front and rear surface images will be further enlarged, and also influence by crossover lights from the both surfaces as described above is exerted, whereby significant lowering in sharpness is brought about.

Thus, in the system of the prior art, a substantially equal combination of the both surface images were observed. However, the present inventors investigated variously, and consequently found that sharpness of images from a low density region to a medium density region can be remarkably improved by biasing images toward either a front surface or a rear surface depending on its density region.

When an emulsion layer is provided only on one surface, sharpness is not lowered, but since the same amount of a silver halide emulsion should coated in order to obtain the same property as that of the both surface system, development processing characteristics are deteriorated to a great extent, whereby there involve problems of lowering in sensitivity, color leftover and deterioration of stored images due to residual silver and residual hypo.

In the present invention, an emulsion layer is coated on both surfaces of a support, but the characteristic feature of the present invention resides in that light-sensitive emulsions on both surfaces have different sensitivities such a feature of which is different from the prior art and yet that photography is conducted by exposing only from one surface.

The sensitivity of the emulsion layer at one side (A surface) of the light-sensitive silver halide photographic material according to the present invention is preferably 1.5 times or more, more preferably 2.0 times to 10 times as high as the sensitivity of the emulsion layer at the other side (B surface).

The weight ratio of silver to gelatin of the (A surface) is required to be larger, preferably by 1.2 times or more, than the weight ratio of silver to gelatin of the (B surface).

The difference in sensitivity mentioned in the present invention is determined with a light source by which the light-sensitive material used in the present invention is photographed.

For example, the difference in sensitivity of regular X-ray films can be measured by using a X-ray fluorescent intensifying screen for photographing regular X-ray films, and that of ortho X-ray films can be measured by using a X-ray fluorescent intensifying screen for photographing ortho X-ray films. If a system utilizing another light source (such as panchromatic and infrared rays) appears in the future, the difference in sensitivity will be measured by using a light source used in combination with a light-sensitive material.

The value of sensitivity can be given as a reciprocal of X-ray dosage necessary for obtaining an optical density of 40% of a maximum optical density (not including a support density) obtained by development.

The light-sensitive silver halide photographic material according to the present invention can be exposed from a high sensitivity surface side by using a light having a wavelength of 300 nm or more and a latent-image forming performance, followed by development, to obtain images.

As a light source of 300 nm or more, in light-sensitive materials for laser imagers, for examples, light sources of 820 nm and 780 nm which are wavelengths of laser beams for semiconductors, and those of 633 nm for He—Ne can be employed. They can be also applied to indirect X-ray films.

As in the case of black and white photographs for medical use, when a density of information quantity from photographs is substantially centered in 2.0 or less, it is extremely effective to photograph a low density portion substantially on a surface at a light source side as a means for preventing deterioration of sharpness of photographs at the time of photography and observation.

Another object of the present invention is to make a sensitivity of films for one surface exposure system higher. For obtaining desired high sensitivity and maximum density, a large amount of silver halide with a large grain size should be coated. However, as described above, when a large amount of a silver halide layer is provided on one surface of a support, processing characteristics such as development, fixing, washing and drying are deteriorated, which goes against the present situation that photographic constituent layers have become thinner for rapid processings.

As a total amount of silver halide at the side constituting a high sensitivity layer of the light-sensitive material of the present invention, since it is preferred to use silver halide grains with an average grain size larger than that of silver halide grains of a low sensitivity layer and a density is preferably made as high as possible, an amount of silver halide attached is preferably made large at a high sensitivity layer side.

As a constitution for accomplishing the objects of the present invention, a total amount of silver halide at the side constituting a high sensitivity layer is 1.1 times or more, preferably 1.2 times or more, but preferably 5 times or less as large as a total amount of silver halide at a low sensitivity layer side. If the ratio exceeds the above range, an advantage obtained by providing silver halide on both surfaces of a light-sensitive material for the purpose of one surface exposure as in the present invention cannot be exhibited effectively.

In the light-sensitive silver halide photographic material of the present invention, when one surface exposure is effected from a high sensitivity surface side, an amount of a light transmitted through a support from a high sensitivity surface and reaching to a low sensitivity surface (crossover light) is preferably larger than that of a both surface type light-sensitive material for X-ray photography. Actually, a transmitted light of a light source used is preferably in the range of 12% to 75% more preferably 16% to 65%. If a transmitted light is increased exceeding the above range, deterioration of sharpness is brought about.

Further, at least one polyvalent alcohol compound is preferably contained in an amount of $5.0\times10^{-5}$ to $5.0\times10^{-3}$ mole per gram of gelatin in constituent layers of said light-sensitive material.

As the polyvalent alcohol to be used in the present invention, preferred is an alcohol having 2 to 12 hydroxyl groups in a molecule and having 2 to 20 carbon atoms, in which hydroxyl groups are not conjugated to each other with a conjugating chain, namely an alcohol of which an oxidized type chemical formula cannot be written. Further, an alcohol having a melting point of 50° C. to 300° C. is preferred.

$S_{B'}/S_B$ of the present invention is preferably 0.12 to 0.75. Here, $S_{B'}/S_B$ is defined as follows. SB is a sensitivity of only the B surface when exposure is carried out only from the B surface (the low-sensitivity layer). $S_{B'}$ is a sensitivity of only the B surface when exposure is carried out only from the A surface (the high-sensitivity layer). If it is less than 0.12, an amount of a transmitted light from a high sensitivity surface to a low sensitivity surface is small, and image-forming efficiency of a low sensitivity surface is extremely lowered undesirably. Further, since light absorption in an emulsion layer of a high sensitivity surface is large, an exposure amount in the vicinity of a support is reduced to a great extent when compared with an exposure amount in the vicinity of a surface of a high sensitivity surface emulsion layer, and therefore exposure amounts in the vicinity of a surface and in the vicinity of a support becomes different to bring about low contrast of a high sensitivity surface. When high contrast should be obtained with a low maximum density of a high sensitivity surface as the samples of the present invention, there are disadvantages.

On the contrary, if it exceeds 0.75, sharpness is lowered due to scattering within a high sensitivity surface, and an amount of a transmitted light to a low sensitivity surface becomes too large. Therefore, when an exposure amount necessary for obtaining a sufficient density of a high sensitivity surface is given, since an amount of a light transmitted to a low sensitivity surface is large, images are formed on a low sensitivity surface, whereby lowering in sharpness is liable to be brought about undesirably.

In the following, specific example of the polyvalent alcohol which can be used preferably in practicing the present invention are shown, but those which can be used in the present invention are not limited to these specific examples.

| No. | Compound Name | Melting point (°C.) |
|---|---|---|
| B-1 | 2,3,3,4-tetramethyl-2,4-pentanediol | 76 |
| B-2 | 2,2-dimethyl-1,3-propanediol | 126–128 |
| B-3 | 2,2-dimethyl-1,3-pentanediol | 60–63 |
| B-4 | 2,2,4-trimethyl-1,3-pentanediol | 52 |
| B-5 | 2,5-hexanediol | 43–44 |
| B-6 | 2,5-dimethyl-2,5-hexanediol | 92–93 |
| B-7 | 1,6-hexanediol | 42 |
| B-8 | 1,8-octanediol | 60 |
| B-9 | 1,9-nonanediol | 45 |
| B-10 | 1,10-decanediol | 72–74 |
| B-11 | 1,11-undecanediol | 62–62.5 |
| B-12 | 1,12-dodecanediol | 79–79.5 |
| B-13 | 1,13-tridecanediol | 76.4–76.6 |
| B-14 | 1,14-tetradecanediol | 83–85 |
| B-15 | 1,12-octadecanediol | 66–67 |
| B-16 | 1,18-octadecanediol | 96–98 |
| B-17 | cis-2,5-dimethyl-3-hexene-2,5-diol | 69 |
| B-18 | trans-2,5-dimethyl-3-hexene-2,5-diol | 77 |
| B-19 | 2-butyne-1,4-diol | 55 |
| B-20 | 2,5-dimethyl-3-hexyne-2,5-diol | 95 |
| B-21 | 2,4-hexadiyne-1,6-diol | 111–112 |
| B-22 | 2,6-octadiyne-1,8-diol | 88.5–89.5 |
| B-23 | 2-methyl-2,3,4-butanetriol | 49 |
| B-24 | 2,3,4-hexanetriol | approx. 47 |
| B-25 | 2,4-dimethyl-2,3,4-pentanetriol | 54 |
| B-26 | 2,4-dimethyl-2,3,4-hexanetriol | 75 |
| B-27 | pentanemethylglycerin | 116–117 |
| B-28 | 2-methyl-2-oxymethyl-1,3-propanediol | 199 |
| B-29 | 2-isopropyl-2-oxymethyl-1,3-propanediol | 83 |
| B-30 | 2,2-dihydroxymethyl-1-butanol | 58 |
| B-31 | erythritol | 126 |
| B-32 | D-threitol | 88 |
| B-33 | L-threitol | 88–89 |
| B-34 | rac-threitol | 72 |
| B-35 | pentaneerythritol | 260–265 |
| B-36 | 1,2,3,4-pentanetetrol | 106 |
| B-37 | 2,3,4,5-hexanetetrol | 162 |
| B-38 | 2,5-dimethyl-2,3,4,5-hexanetetrol | 153–154 |
| B-39 | 1,2,5,6-hexanetetrol | 95 |
| B-40 | 1,3,4,5-hexanetetrol | 88 |
| B-41 | 1,6-(erythro-3,4)-hexanetetrol | 121–122 |
| B-42 | 3-hexene-1,2,5,6-tetrol | 80–82 |
| B-43 | 3-hexyne-1,2,5,6-tetrol | 113–114.5 |
| B-44 | adonitol | 102 |
| B-45 | D-arabitol | 102 |
| B-46 | L-arabitol | 102 |
| B-47 | rac-arabitol | 105 |
| B-48 | xylitol | 93–94.5 |
| B-49 | mannitol | 164 |
| B-50 | dulcitol | 188.5–189 |

The above compounds according to the present invention are each easily available as a commercial product.

The light-sensitive silver halide photographic material of the present invention contains gelatin in an amount of 1.5 g/m$^2$ to 6.5 g/m$^2$, preferably 2.0 g/m$^2$ to 4.5 g/m$^2$ per one surface thereof.

The present invention can be applied to conventional light-sensitive materials having an emulsion on one surface for CRT photography, photography with a laser printer or a laser imager and photography of chest.

The present invention is further characterized in that the light-sensitive material according to the present invention is exposed only from one surface. In this case, either a front surface or a rear surface of a film may be positioned at an X-ray incidence side, but a surface of a high sensitivity layer is preferably positioned at an incidence side.

When a X-ray fluorescent intensifying screen is used, it may be set at either a front side or a back side of a film, but a X-ray fluorescent intensifying screen is preferably set at a high sensitivity emulsion layer side, whereby the effect of the present invention can be exhibited favorably.

In the following, main preferred embodiments of the present invention are described in detail.

Silver halide grains to be used in the high sensitivity emulsion surface of the present invention are preferably silver iodobromide or silver iodochlorobromide having a silver iodide content of 3 mole % or less, and more preferably a silver iodochlorobromide emulsion comprising 0.1 to 2.5 mole % of silver iodide, 97.5 mole % or more of silver bromide and 0 to 2.0 mole % of silver chloride.

The amount of silver halide to be coated on the high sensitivity surface is preferably 4.0 $g/m^2$ or less, more preferably in the range of 1.0 to 3.5 $g/m^2$ calculated on silver, and the amount on the low sensitivity surface is preferably 3.0 $g/m^2$ or less, more preferably in the range of 0.1 to 2.5 $g/m^2$.

The fog mentioned in the present invention refers to the sum of a support density and a density of developed silver at unexposed portions after development processing, namely the so-called gross fog.

The maximum density of the high sensitivity surface of the light-sensitive material according to the present invention is preferably 1.9 or more, more preferably 2.0 to 3.4, when exposed from the high sensitivity surface.

The maximum density of the low sensitivity surface is preferably 0.4 or more, more preferably 0.5 to 2.5, when exposed from the low sensitivity surface.

The light-sensitive material of the present invention is so designed that a low density portion and a medium density portion (about a density of 2.0) are formed substantially only on the high sensitivity surface by an exposure from a high sensitivity surface side, and the low sensitivity surface is sensitized by the light transmitted through the high sensitivity surface and a support to form a high density portion. In images for medical use, a density region particularly useful for diagnoses is in the range of from a fog density to a density of 1.6 to 2.3. In many cases, a high density region having a density of 1.6 to 2.3 or more is utilized effectively not only for diagnoses at that portion, but also for easy observation of a portion useful for diagnoses at a density of 1.6 to 2.3 or less. Accordingly, the high density portion may be formed of images which are formed by a crossover light only from one surface and having low sharpness without practical problems. Rather, by forming images at a density in the range of from a fog density to a density of 1.6 to 2.3 only on the high sensitivity surface, images which are not influenced by a crossover light at all and not lowered in sharpness even in oblique photography can be formed.

Thus, the light-sensitive material of the present invention is a light-sensitive material having a high sensitivity surface and a low sensitivity surface with different sensitivities, preferably a light-sensitive material in which substantial images are not formed on a low sensitivity surface at a low exposure region until a density of 1.6 to 2.3 is formed on a high sensitivity surface, depending on uses of a light-sensitive material.

Generally, by designing a light-sensitive material so that when an exposure in which a density at a high sensitivity surface becomes a density of (fog+1.60) is given from a high sensitivity surface side, a density of a low sensitivity surface is a density of (fog+0.20) or less, images useful as diagnostic images and having extremely high sharpness at a low density region to a medium density region can be obtained. In the most preferred embodiment, the light-sensitive material of the present invention is used for forming images on the low sensitivity surface by a light transmitted through the high sensitivity surface, and therefore an amount of a transmitted light of a light from the high sensitivity surface to the low sensitivity surface is preferably larger than that of a both surface type light-sensitive material for X-ray photography used in general, preferably in the range of 12% to 75%.

Incidentally, values of sensitivity, gamma, fog and maximum density mentioned in the present invention are values determined by using processing agents and processing conditions described in Examples of the present invention.

As described above, the light-sensitive silver halide photographic material according to the present invention is characterized in that a silver halide emulsion layer is coated on both surfaces of a support and the emulsions on the front surface and the rear surface have different sensitivities.

Accordingly, the point different from the conventional both surface film system is that it is necessary for users to easily distinguish between a sensitivity of the front surface and a sensitivity of the rear surface during handling of a film, when a film and a X-ray fluorescent intensifying screen are loaded at the time of photography, or during development.

Further, when a film is loaded in a cassette, a light-sensitive surface of the film and a surface of a X-ray fluorescent intensifying screen are required to be brought into close contact with each other appropriately. For facilitating distinction between a front surface and a rear surface, film makers have developed a film having a notch provided at a specific part thereof.

However, since notches are different in shape and position depending on a kind of a film or a film maker, erroneous loading is liable to occur in darkrooms, which frequently results in a serious mistake. Accordingly, it has been demanded to solve such a problem urgently.

The problem can be solved by a system for X-ray photography in which said light-sensitive material and said cassette have substantially the same uneven shape.

The above cassette refers to a cassette generally used for X-ray photography which is a film container made of aluminum, carbon or lead.

Substantially the same uneven shape possessed by the cassette and the light-sensitive material refers to a state that a certain position of the light-sensitive material is notched within the range which does not impair a photographed image, and the cassette has a shape which is coincident with the shape of the film notch. The shape and the position of the uneven shape are not particularly limited, but the size may be as small as possible within the range that the effect of the present invention can be obtained, and the position may be upper, lower, left and right, and yet the shape and the position by which coincidence between the film notch and the cassette notch is easily given are employed.

Further, a conventional cassette to which an uneven substance (its shape is selected as desired) having a shape which is coincident with a shape of a film notch is attached may be employed.

Figure 1A:
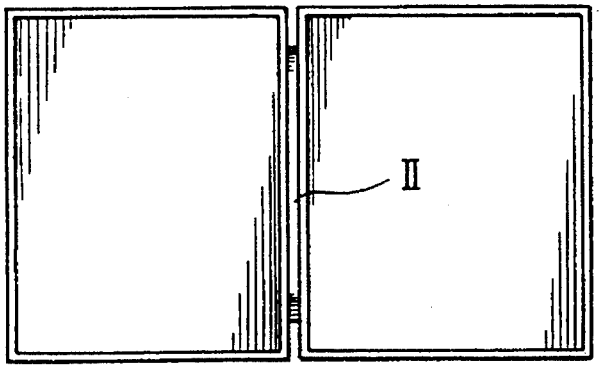
FIG. 1(a) PRIOR ART

FIG. 1 shows one example of plane views of a film and a cassette used at present.

(*a*) is a film, and (*a'*) is a cassette for the film.

Figure 2:
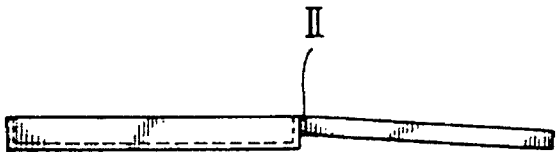
FIG. 2 PRIOR ART
FIG. 2 is a side view of the cassette (a') for the film.
Figure 3B:
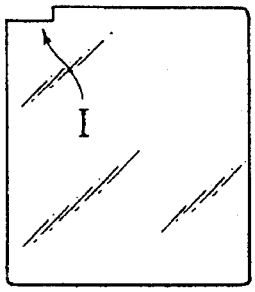
FIGS. 3(*b*), 3(*b'*), 3(*c*), 3(*c'*), 3(*d*), and 3(*d'*) shows plane views showing three examples of the film with 10×12 inch size and the cassette for the film according to the present invention, wherein I represents a notch of the film, and I'represents a part of the cassette coincident with the film in shape, which has substantially the same uneven shape as I of the corresponding film and II represents a hinge of the cassette.
Figure 3B:
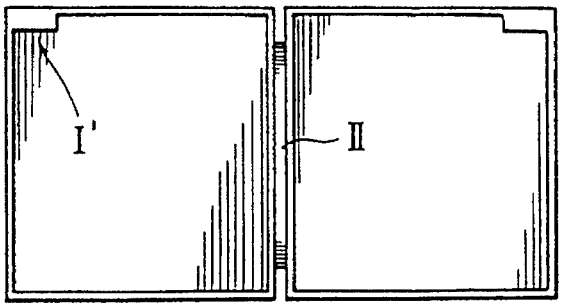
Figure 3C:
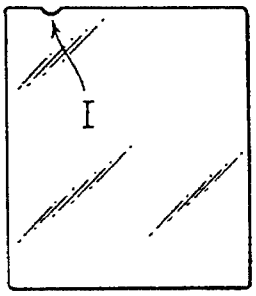
Figure 3C:
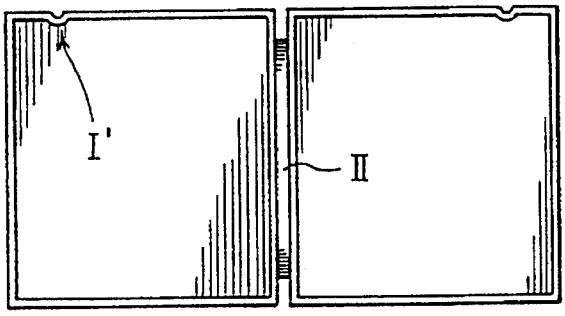
Figure 3D:
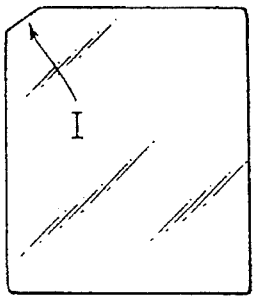
Figure 3D:
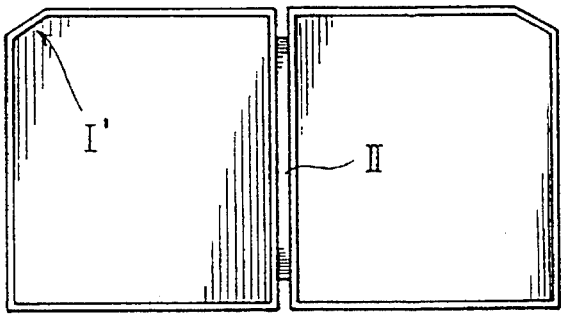
Figure 4:
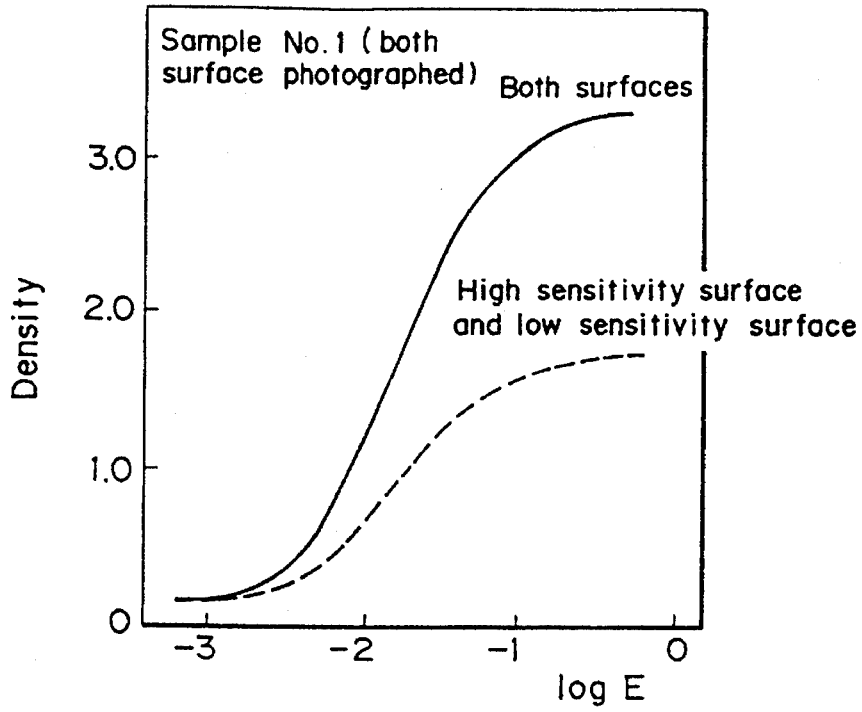
FIG. 4 to FIG. 11 are characteristic curves of the light-sensitive silver halide photographic material obtained in Example 3 of the present invention.
Figure 5:
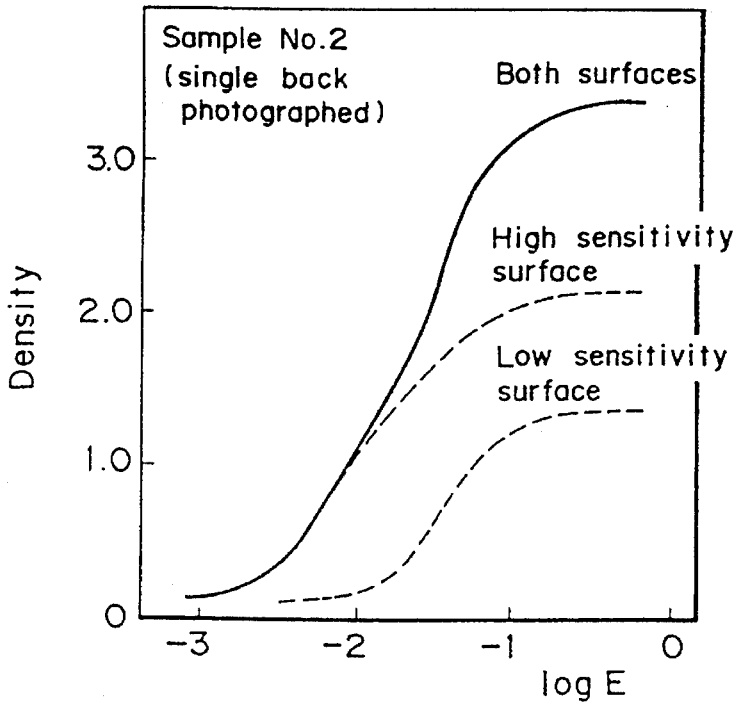
Figure 6:
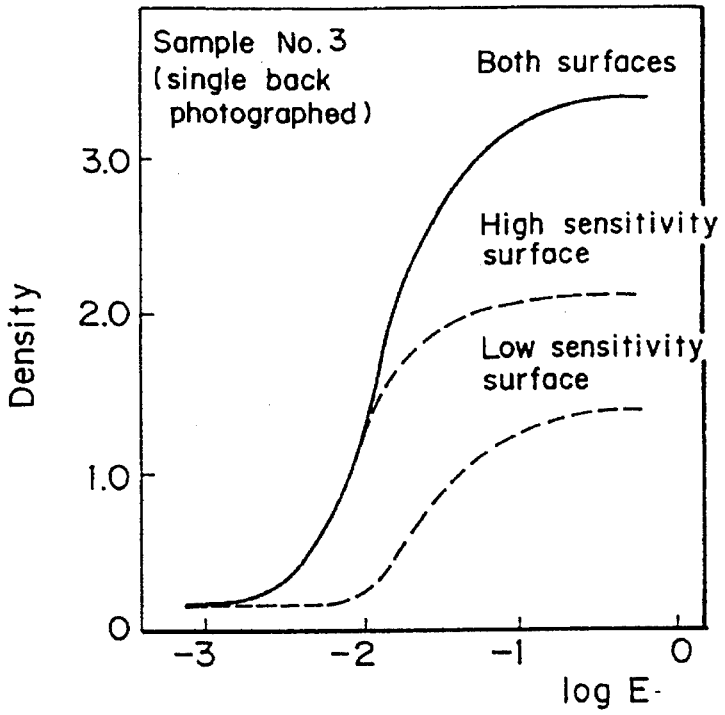
Figure 7:
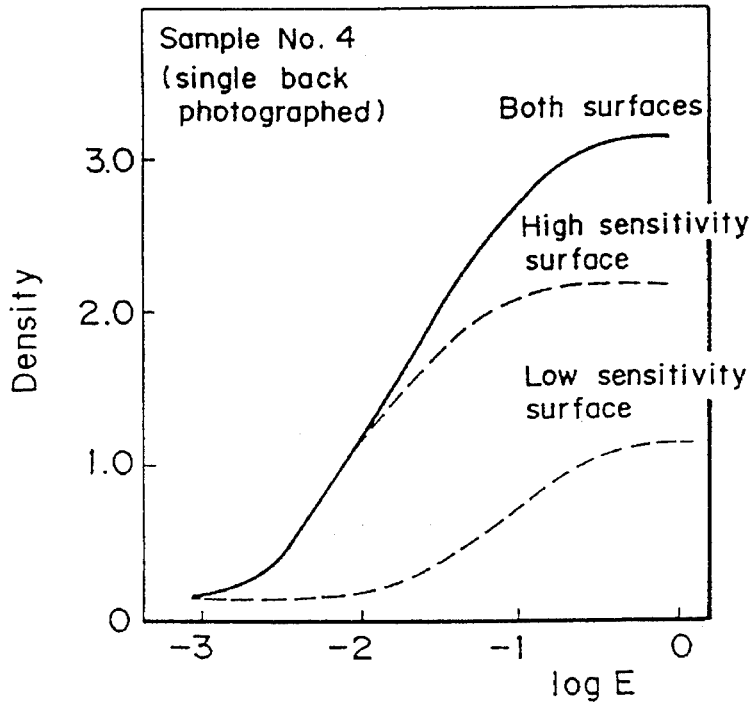
Figure 8:
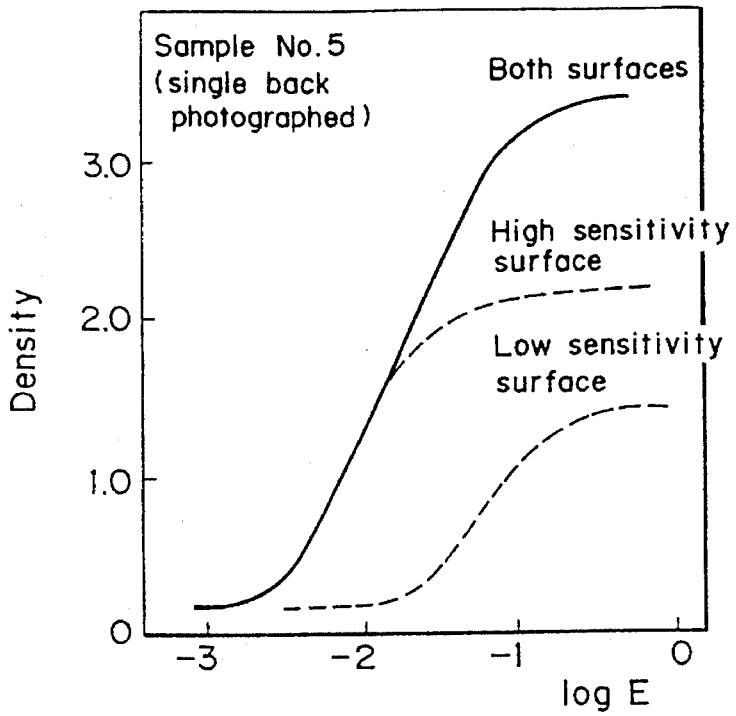
Figure 9:
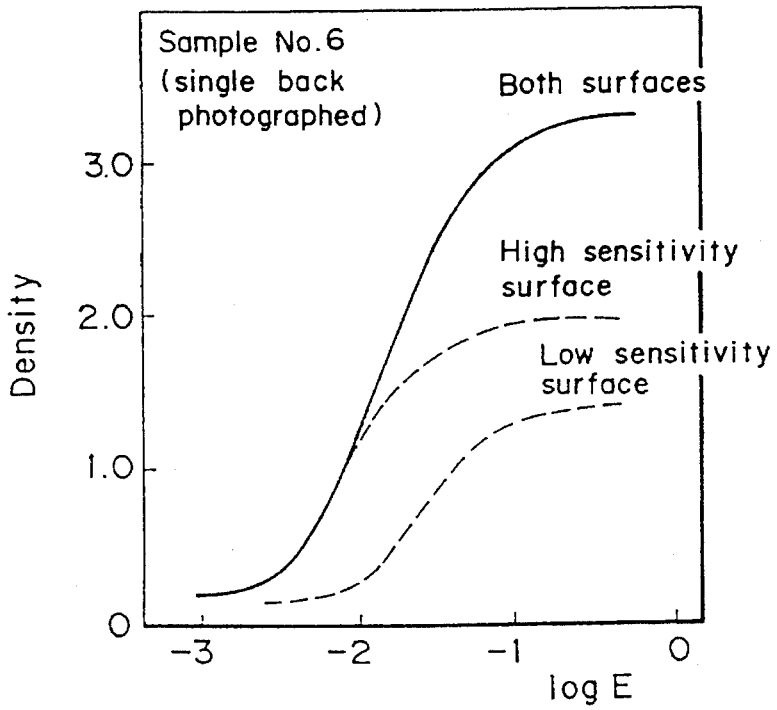
Figure 10:
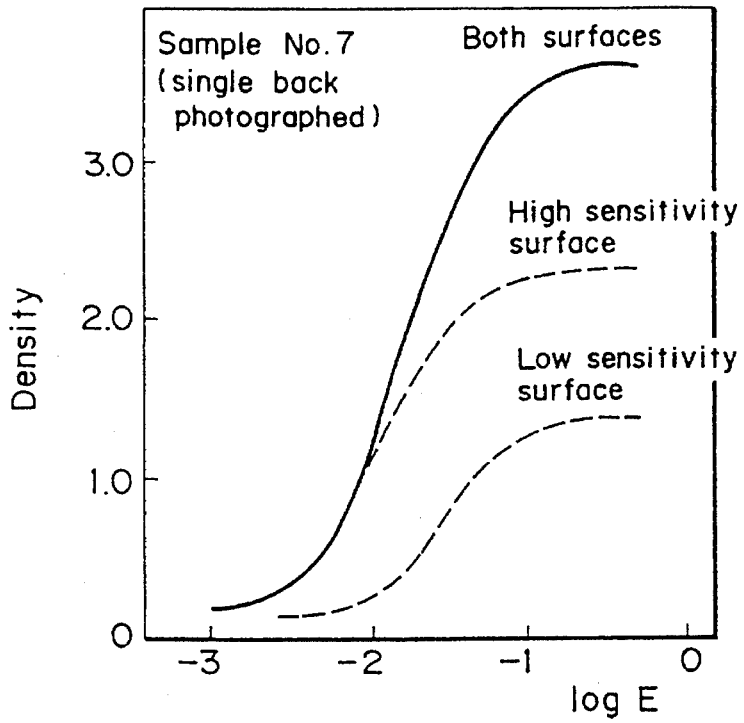
Figure 11:
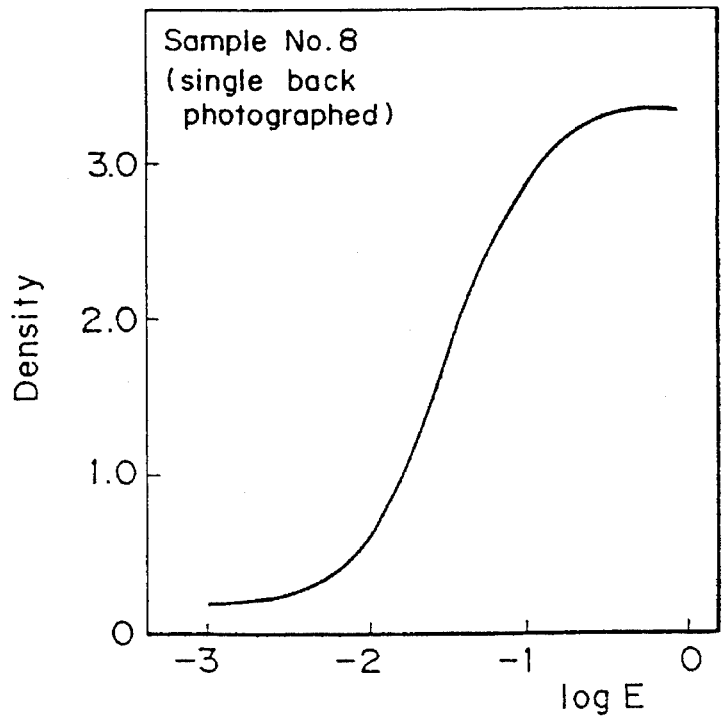

FIG. 2 is a side view of the cassette for the film used at present.

FIG. 3 shows plane views (three examples) of films and cassettes for the films used in the system for X-ray photography according to the present invention.

In FIG. 3, (*b*) is a plane view of a film having an emulsion coated on its surface and having a rectangular notch provided in the left corner, and (*b'*) is a plane view of a cassette for said film having substantially the same shape as the film.

Similarly, (*c*) is a film having a semi circular notch provided in its left corner, (*c'*) is a cassette for said film, (*d*) is a film having its left corner cut off, and (*d'*) is a cassette for said film.

In the prior art, a mark which absorbs X-rays is attached to a cassette so that a left side and a right side of a film photographed can be recognized at the time of observation after development. However, according to the photographing system of the present invention, it is not necessary to attach such a mark, and there is an advantage that a photographed position is easily recognized by a film notch. Further, the point different from the prior art is that an uneven position of a film can be recognized by a cassette shape itself even when seen from outside. Accordingly, it has been found that the present invention is extremely useful not only for preventing erroneous loading, but also for preventing wrong diagnoses because of its advantage at the time of photography and observation.

The cassette for the film according to the present invention may be a cassette comprising the same material and the same constitution as those conventionally used, but preferably a cassette in which a film-receiving frame having a shape coincident with an uneven shape of the film is provided, more preferably a cassette also having an outer frame of which a shape is coincident with an uneven shape of the film, whereby the effect of the present invention can be exhibited more favorably. For example, in the cassettes shown in FIG. 3, not only the inner frames but also the outer frames have an uneven shape so that the inner uneven shape can be recognized from the outer uneven shape.

However, an outer frame may not have an uneven shape. Depending on the case, a seal may be attached to an outer surface of a cassette so that an uneven position within a cassette can be recognized.

The emulsion to be used in the light-sensitive silver halide photographic material of the present invention may be any silver halide such as silver iodobromide, silver iodochloride and silver iodochlorobromide, but particularly preferably silver iodobromide for obtaining high sensitivity.

The silver halide grains in the photographic emulsion may have any shape such as cubic, octahedron and tetradecahedron which grow in an isotropic manner, or a polyhedral crystal such as sphere and a twin having defects in phases or a mixture or complex thereof. The silver halide grains may be fine grains having a grain size of 0.1 μm or less to greater grains having that of 20 μm or less.

The emulsion to be used in the light-sensitive silver halide photographic material of the present invention can be prepared according to a known method. For example, the emulsion can be prepared according to "1. Emulsion Preparation and types" disclosed on pp. 22 to 23 of Research Disclosure (RD) No. 17643 (December, 1978) and the method disclosed on p. 648 of RD No. 18716 (November, 1979).

The emulsion used in the light-sensitive silver halide photographic material according to the present invention can be prepared according to, for example, the methods disclosed on pp. 38 to 104 of "The theory of the photographic process", 4th edition, written by T. H. James, published by MacMillan Co. (1977), "Photographic Emulsion Chemistry" written by G. F. Dauffin, published by Focal Press Co. (1966), "Chimie et physique photographique" written by P. Glafkides, published by Paul Montel Co. (1967) and "Making and coating photographic emulsion" written by V. L. Zelikman et al, published by Focal Press Co. (1964).

Specifically, the emulsion can be prepared under a solution condition such as a neutral method, an acidic method and an ammoniacal method, a mixing condition such as a normal precipitation, a reverse precipitation, a double jet method and a controlled double jet method and a grain preparation condition such as a conversion method, a core/shell method and a combination thereof.

As one of the preferred embodiments of the present invention, a monodispersed emulsion in which silver iodide is localized internally of grains can be mentioned.

As the silver halide emulsion to be used preferably in the present invention, there may be mentioned a monodispersed grain comprising an inner portion with a high iodine content as disclosed in, for example, Japanese Unexamined Patent Publications No. 177535/1984, No. 116347/1986, No. 132943/1986, No. 49751/1988 and No. 85846/1990. A crystal habit of the crystal may be cubic, tetradecahedral or octahedral, and (1,1,1) face and (1,0,0) face which are intermediate therebetween may exist arbitrarily.

The monodispersed emulsion herein mentioned refers to a silver halide grain wherein when an average grain diameter is measured according to a conventional method, at least 95% of grains in terms of grain number or weight have a grain diameter within ±40%, preferably within ±30% of the average grain size. The grain size distribution of the silver halide may be either a narrow distribution as in a monodispersed emulsion or a wide distribution as in a polydispersed emulsion.

The definition of the monodispersibility mentioned above is described in Japanese Unexamined Patent Publication No. 162244/1985, and in the definition, variation coefficient of grain size is 0.20 or less.

An inner portion and an outer portion of a crystalline structure of the silver halide may comprise different silver halide compositions.

As a preferred embodiment of the present invention, the emulsion is a core/shell type monodispersed emulsion having a two-layered structure comprising a core portion with a high iodine content and a shell layer with a low iodine content.

The content of silver iodide in the portion with a high iodine content is preferably 20 to 40 mole % particularly preferably 20 to 30 mole %.

A method for preparing such a monodispersed emulsion is known in the art, and disclosed in, for example, J. Phot. Sci. 12, pp. 242 to 251 (1963), Japanese Unexamined Patent Publications No. 36890/1973, No. 16364/1977, No. 142329/1980 and No. 49938/1983, U.K. Patent No. 1,413,748, U.S. Pat. Nos. 3,574,628 and 3,655,394.

As the monodispersed emulsion described above, particularly preferred is an emulsion in which a seed crystal is used as a growth nucleus and the seed crystals are grown by supplying silver ions and halide ions. Further, a method for obtaining a core/shell emulsion is disclosed in detail in, for example, U.K. Patent No. 1,027,146, U.S. Pat. Nos. 3,505, 068 and 4,444,877, and Japanese Unexamined Patent Publication No. 14331/1985.

Another grain form of the silver halide emulsion to be used in the present invention is preferably a tabular grain having an aspect ratio of 3 or more.

Such a tabular grain having advantages of improvement in spectral sensitizing efficiency and improvement in graininess and sharpness of images is disclosed in, for example, U.K. Patent No. 2,112,157, U.S. Pat. Nos. 4,439,520, No. 4,433,048, No. 4,414,310 and No. 4,434,226, and Japanese Unexamined Patent Publications No. 113927/1983No. 127921/1983, No. 138342/1988, No. 284272/1988 and No. 305343/1988, and the emulsion can be also prepared according to the methods disclosed in these publications.

The above emulsion may be any type of emulsions such as a surface latent image type in which an latent image is formed on a grain surface, an internal latent image type in which a latent image is formed internally of a grain or a type in which a latent image is formed both on a grain surface and internally of a grain. In these emulsions, during physical ripening or preparation of grains, a cadmium salt, a lead salt, a zinc salt, a thallium salt, an iridium salt or a complex salt thereof, a rhodium salt or a complex salt thereof and an iron salt or a complex salt thereof may be used. For removing soluble salts therefrom, the emulsion may be subjected to washing by a noodle washing method or a flocculation sedimentation method. As a preferred washing method, there may be included, for example, a method by using an aromatic hydrocarbon type aldehyde resin containing a sulfo group as disclosed in Japanese Patent Publication No. 16086/1960 and a method by using exemplary compounds G3 and G8 of a coagulating polymeric agent as disclosed in Japanese Unexamined Patent Publication No. 158644/1988, which are particularly preferred desalting methods.

In the emulsion according to the present invention, in the step before and after physical ripening or chemical ripening, various additives for photography can be used. As the additive known in the art, compounds disclosed in, for example, Research Disclosure No. 17643 (December, 1978) and Research Disclosure No. 18716 (November, 1979) are included Kinds of the compounds disclosed in these two Research Disclosures and pages are shown below.

| | RD-17643 | | RD-18716 | |
|---|---|---|---|---|
| Additive | Page | Class | Page | Class |
| Chemical Sensitizer | 23 | III | 648, | light upper column |
| Sensitizing dye | 23 | IV | 648, 649, | right column to left column |
| Development accelerator | 29 | XXI | 648, | right upper column |
| Antifoggant | 24 | VI | 649, | right lower column |
| Stabilizer | 24 | VI | | |
| Antistaining agent | 25 | VII | 650, | left to right columns |
| Image stabilizer | 25 | VII | | |
| UV absorber | 25 to 26 | VIII | 649, 650, | right column to left column |
| Filter dye | 25 to 26 | VIII | | |
| Brightener | 24 | V | | |
| Hardener | 26 | X | 651, | left column |
| Coating aid | 26 to 27 | XI | 650, | right column |
| Surfactant | 26 to 27 | XI | 650, | right column |
| Plasticizer | 27 | XII | 650, | right column |
| Lubricant | 27 | | | |
| Antistatic agent | 27 | XII | 650, | right column |

-continued

| | RD-17643 | | RD-18716 | |
|---|---|---|---|---|
| Additive | Page | Class | Page | Class |
| Matte agent | 28 | XVI | 650, | right column |
| Binder | 26 | IX | 651, | left column |

As a support which can be used in the light-sensitive material according to the present invention, for example, those disclosed on p. 28 of RD No. 17643 and in the left column of p. 647 of RD No. 18716 can be mentioned.

The suitable support is a plastic film. Generally, for enhancing adhesiveness of the support to a coating layer, a prime-coating layer may be provided on a surface of the support or a surface of the support may be subjected to corona discharging or UV irradiation. On both surfaces of the support thus treated, the emulsion according to the present invention can be coated.

In the following, the present invention is described by referring to Examples. As a matter of course, the present invention is not limited by Examples as described below at all.

EXAMPLE 1

(1) Preparation of monodispersed grain

Monodispersed emulsion grains comprising silver iodobromide containing 2.0 mole % of silver iodide with an average grain size of 0.2 μm and having a shape of cubic and good variation coefficient which is a measure of monodispersibility of 0.15 were used as a nucleus, and silver iodobromide containing 30 mole % of silver iodide was grown at pH 9.8 and pAg 7.8. Subsequently, at pH 8.2 and pAg 9.1, equimolar amounts of potassium bromide and silver nitrate were added to prepare emulsions comprising 4 kinds of tetradecahedral monodispersed emulsion grains comprising silver iodobromide with an average silver iodide content of 2.2 mole %, having average grain sizes of 0.375 μm, 0.64 μm, 1.22 μm and 1.88 μm, respectively, and having coefficients of variation of 0.17, 0.16, 0.16 and 0.17, respectively. These emulsions were called ①-1, ①-2, ①-3 and ①-4, respectively.

The emulsions were subjected to desalting to remove excessive salts according to a conventional coagulation method. Specifically, to the emulsions maintained at 40° C., a formalin condensate of sodium naphthalenesulfonate and an aqueous solution of magnesium sulfate were added to effect coagulation, and a supernatant was removed.

(2) Preparation of tabular grain emulsion ②

To 5.5 l of a 1.5% gelatin solution containing 0.17 mole of potassium bromide, a solution of 2.1 mole of potassium bromide and 2.0 mole of silver nitrate was added under stirring over 3 minutes at 80° C. and pH 5.7 according to a double jet method. pBr was maintained 0.8. (0.53% of total silver nitrate used was consumed.) Addition of the potassium bromide solution was stopped, and addition of the silver nitrate solution was continued for 4.6 minutes. (8.6% of total silver nitrate used was consumed.) Subsequently, the potassium bromide solution and the silver nitrate solution were added simultaneously for 12 minutes. During this addition, pBr was maintained 1.15, and the addition flow was accelerated so that the flow at the time of completion of the addition became 2.3 times as much as the flow at the time of initiation of the addition. (43.6% of total silver nitrate used was consumed.)

Addition of the potassium bromide solution was stopped, and the silver nitrate solution was added for 1 minute. (4.7% of total silver nitrate used was consumed.) 2.1 mole of a potassium bromide solution containing 0.55 mole of potassium iodide was added together with the silver nitrate solution over 12.0 minutes. During this addition, pBr was maintained 1.7, and the flow was accelerated so that the flow at the time of completion of the addition became 1.5 times as much as the flow at the time of initiation of the addition. (35.9% of total silver nitrate used was consumed.) To the emulsion obtained, 1.5 g/mole Ag of sodium thiocyanate was added, and the mixture was maintained for 25 minutes. According to a double jet method, a solution of 0.60 mole of potassium bromide and silver nitrate was added at a homogeneous flow for about 5 minutes until pBr reached to 3.0. (about 6.6% of total silver nitrate used was consumed.) The total amount of silver nitrate consumed was about 11 mole. Thus, an emulsion ② containing tabular silver iodobromide grains with an average grain diameter of 1.80 μm and having an aspect ratio of about 9:1 was prepared. 80% or more of total projected area of the silver iodobromide grains were tabular grains.

Preparation, processing and evaluation of samples

To the respective silver halide emulsions ①-1, ①-2, ①-3, ①-4 and ②, pure water was added so that a volume per mole of silver became 500 ml, and then a temperature of the respective mixtures was made 55° C. Spectral sensitizing dyes A and B shown below were added at a weight ratio of 200:1 in total amounts of 820 mg to ①-1, 600 mg to ① -2, 360 mg to ①-3, 500 mg to ①-4 and 600 mg to ② per mole of silver halide, respectively.

After 10 minutes, ammonium thiocyanate was added in amounts of $4\times10^{-3}$ mole to ①-1, $2\times10^{-3}$ mole to ①-2, $1\times10^{-3}$ mole to ①-3, $1.6\times10^{-3}$ mole to ①-4 and $3\times10^{-3}$ mole to ② per mole of silver, and further appropriate amounts of chloroauric acid and hypo were added to initiate chemical ripening. The chemical ripening was effected under the conditions of a pH of 6.15 and a silver potential of 50 mV.

Fifteen minutes before completion of the chemical ripening (70 minutes after initiation of the chemical ripening), potassium iodide was added in an amount of 200 mg per mole of silver. After 5 minutes, 10% (weight/volume) acetic acid was added to lower the pH to 5.6, and then the pH value was maintained for 5 minutes. Subsequently, a 0.5% (weight/volume) solution of potassium hydroxide was added to return the pH to 6.15, and then 4-hydroxy-6-methyl1,3, 3*a*,7-tetrazaindene was added to complete the chemical ripening.

Emulsions ①-1, ①-2, ①-3, ①-4 and ② obtained were mixed as shown in Table 1, and to the mixtures, additives for emulsion described below were added to obtain preparation solutions.

A solution of sodium carbonate and potassium bromide was used for preparation so that photographic emulsion coating solutions had a pH of 6.40 and a silver potential of 74 mV (35° C.) after preparation.

By using the emulsion coating solutions obtained, samples were prepared in the following manner. Specifically, the photographic emulsion layer was prepared to contain gelatin in an amount of 2.0 g/m$^2$ at both a high sensitivity emulsion layer side and a low sensitivity emulsion layer side, and silver halide in an amount calculated on silver as shown in Table 1.

By using additives described below, a protective layer solution was prepared. The protective layer was coated with the emulsion layer prepared as above by two slide hopper type coaters simultaneously on both surfaces of a support at a speed of 80 m/min so that an amount of gelatin attached became 1.15 g/m$^2$, followed by drying for 2 minutes and 20 seconds, to obtain samples. As the support, employed was a blue-colored polyethylene terephthalate film base for an X-ray film having a density of 0.15 with a thickness of 175 μm on which an aqueous dispersion of a copolymer obtained by diluting a copolymer comprising 3 kinds of monomers of 50% by weight of glycidyl methacrylate, 10% by weight of methyl acrylate and 40% by weight of butyl methacrylate so as to have a concentration of 10% by weight was provided by coating as a subbing solution.

The spectral sensitizing dyes used for the preparation of the samples are shown below.

Spectral sensitizing dye A

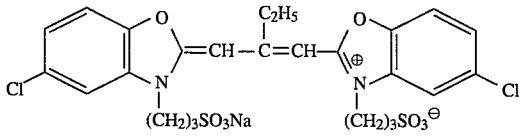

Spectral sensitizing dye B

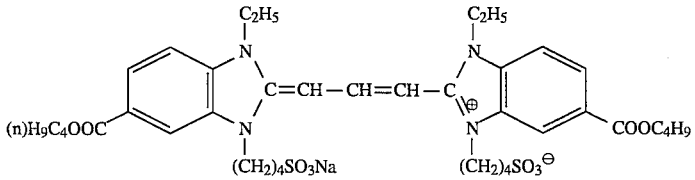

The additives used in the emulsions (light-sensitive silver halide coating solutions) are shown below. The amounts added are represented in an amount per mole of silver halide.

| | |
|---|---|
| 1,1-Dimethylol-1-bromo-1-nitromethane | 70 mg |
| 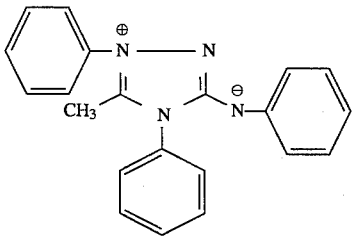 | 150 mg |
| t-Butyl-catechol | 400 mg |
| Polyvinyl pyrrolidone (Mw: 10,000) | 1.0 g |
| Styrene-maleic anhydride copolymer | 2.5 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 1.5 mg |
| 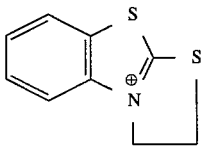 | 70 mg |
| $n\text{-}C_4H_9OCH_2CH(OH)CH_2N(CH_2COOH)_2$ | 1 g |
| 1-Phenyl-5-mercaptotetrazole | 15 mg |
| *(Dye emulsifying dispersion) | 1.2 g |

The additives used in the protective layer solution are shown below. The amounts added are represented in an amount per liter of the coating solution.

| | |
|---|---|
| Lime-treated inert gelatin | 68 g |
| Acid-treated gelatin | 2 g |
| $NaO_3S-CH(CH_2COOC_{10}H_{21})-COOC_5H_{11}$ (coating aid) | 0.3 g |
| Polymethyl methacrylate, a matte agent with an average grain size per unit area of 3.5 μm | 1.1 g |
| Silicon dioxide grain, a matte agent with an average grain size per unit area of 1.2 μm | 0.5 g |
| Ludox AM (trade name, manufactured by Du Pont Co.) (colloidal silica) | 30 g |
| 2% Aqueous solution of 2,4-dichloro-6-hydroxy-1,3,5-triazine sodium salt (hardener) | 10 ml |
| 40% Aqueous glyoxal solution (hardener) | 1.5 ml |
| $(CH_{2CHSO_2}CH_2)_2O$(hardener) | 500 mg |
| 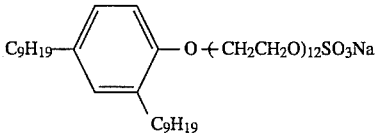 | 1.0 g |

-continued

| | |
|---|---|
| 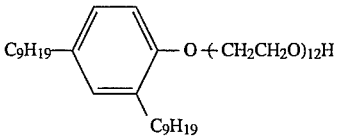 | 0.4 g |
| $NaO_3S-CH(COOCH_2(C_2F_4)_3H)-CH_2COOCH_2(C_2F_4)_3H$ | 0.5 g |
| $C_{12}H_{25}CONH(CH_2CH_2O)_5H$ | 2.0 g |

*The dye emulsifying dispersion was prepared in the following manner.

DYE

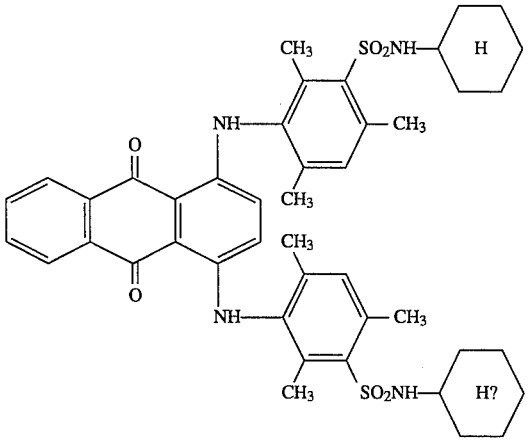

The above dye was weighed with a balance, and 10 kg of the dye was dissolved at 55° C. in a solvent comprising 28 l of tricresyl phosphate and 85 l of ethyl acetate. This solution was called an oily solution. On the other hand, 270 ml of a 9.3% aqueous gelatin solution in which 1.35 kg of an anionic surfactant (AS shown below) was dissolved at 45° C. was prepared. This solution was called an aqueous solution.

(AS)

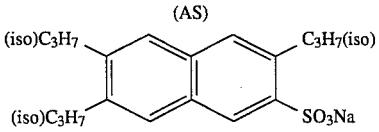

The oily solution and the aqueous solution described above were placed in a dispersing vessel, and dispersed while controlling a solution temperature to be maintained at 40° C.

To the dispersion obtained, the following additives and water were added to make up the mixture to 240 kg, and the mixture was cooled and solidified.

| | |
|---|---|
| 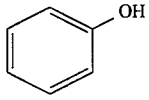 2.5% aqueoussolution | 16 l |
| $HOCH_2-C(NO_2)(Br)-CH_2OH$ | 8 g |

All of the average grain sizes per unit area of the dispersion obtained were within the range of 0.12 to 0.14 μm.

For measuring sensitivities of Sample No. 1 obtained, the samples with which a X-ray fluorescent intensifying screen KO-250 (trade name, manufactured by Konica Corporation) was brought in contact at a high sensitivity emulsion layer side (A surface) and the samples with which said X-ray fluorescent intensifying screen was brought in contact at a low sensitivity emulsion layer side (B surface) according to a single back method using only a rear surface (a method in which a X-ray fluorescent intensifying screen is used only on one surface) were photographed, followed by development processing, to obtain Samples (1 - I) and (1 - II), respectively.

At the time of photography, the side of a cassette at which a X-ray fluorescent intensifying screen was not used was subjected to black coating giving a high light absorbing rate.

The photography was conducted by irradiating X-rays at a voltage in tube of 90 KVP and a current of 20 mA for 0.05 sec, and a sensitometry curve was prepared according to a distance method to determine a sensitivity, a maximum density and gamma.

The development was carried out by an automatic developing machine SRX-501 (trade name, manufactured by Konica Corporation) by using a developing solution and a fixing solution having the compositions described below at a developing temperature of 35° C. and a fixing temperature of 33° C. The washing water was supplied at a temperature of 18° C. in an amount of 1.5 l/min. The whole processing steps were carried out in a 45 second mode.

The sensitivity of the A surface can be obtained by removing the light-sensitive layer at a B surface side from Sample (I) by proteinase, and similarly, the sensitivity of the B surface can be obtained by removing the light-sensitive layer at an A surface side from Sample (II). Further, the total sensitivity can be also obtained from Sample (I).

The sensitivity values were determined as a reciprocal of an X-ray dosage necessary for obtaining a density value which was calculated by multiplying the value obtained by subtracting a support density from a maximum density by 0.4 and adding a support density to the product. As for Samples No. 2 to No. 8, sensitivities were measured in the same manner as above. The values are represented in a relative sensitivity when the sensitivity of Sample No. 1 was defined as 100. (the same may be said of Examples 2 to 5)

Sample No. 1 was subjected to a conventional exposure by using X-ray fluorescent intensifying screens on both surfaces since Sample No. 1 had the same emulsion constituent layer as a conventional X-ray film of both 10 surface type.

In Table 2, the gamma values are represented in a reciprocal of a difference between reciprocals of logarithms of X-ray dosages giving densities of 1.0 and 2.0.

For the samples after coating and drying, the following evaluations were made.

As to image quality of the respective Samples No. 1 to No. 8, sharpness was evaluated by using the actually photographed samples.

The photography was conducted at a voltage in tube of 90 KVP by using a X-ray fluorescent intensifying screen KO-250 only at a high sensitivity emulsion layer side according to the single back method. The same procedures (the same procedures by using the same automatic developer, processing agent, processing temperature and processing time) were carried out as in the above sensitometry curve.

A sharp funk test chart SMS5853 (trade name, available from Konica Medical K.K.) was used for measuring sharpness. The procedures were carried out by using the same voltage in tube and X-ray fluorescent intensifying screen and under the same conditions as in the actual photography.

The respective samples were exposed so that an average density of shades given by the funk test chart became 0.8±0.02.

Developing solution composition

| Developing solution | |
|---|---|
| Potassium sulfite | 60.0 g |
| Hydroquinone | 25.0 g |
| 1-Phenyl-3-pyrazolidone | 1.5 g |
| Boric acid | 10.0 g |
| Potassium hydroxide | 23.0 g |
| Triethylene glycol | 17.5 g |
| 5-Methylbenztriazole | 0.04 g |
| 5-Nitrobenzimidazole | 0.11 g |
| 1-Phenyl-5-mercaptotetrazole | 0.015 g |
| Glutaraldehyde bisulfite | 8.0 g |
| Glacial acetic acid | 16.0 g |
| Potassium bromide | 4.0 g |
| made up to 1 liter with addition of water. | |
| **Fixing solution** | |
| Sodium thiosulfate | 45 g |
| Disodium ethylenediaminetetraacetate | 0.5 g |
| Ammonium thiosulfate | 150 g |
| Anhydrous sodium sulfite | 8 g |
| Potassium acetate | 16 g |
| Aluminum sulfate 18 hydrates | 27 g |
| Sulfuric acid (50% by weight) | 6 g |
| Citric acid | 1 g |
| Boric acid | 7 g |
| Glacial acetic acid | 5 g |
| made up to 1 liter aqueous solution, and adjusted a pH to 4.0 (25° C.) with glacial acetic acid. | |

The developing solution and the fixing solution were used in an automatic developer 24 hours after each preparation.

Evaluation of sharpness

A: Recognizable up to 10 LP/mm with loupe

B: Recognizable up to 8 LP/mm with loupe

C: Recognizable up to 6 LP/mm with loupe

D: Recognizable up to 5 LP/mm with loupe

E: Recognizable up to 4 LP/mm with loupe

In the above evaluation, A represents the most excellent sharpness, and E represents the worst sharpness. The results obtained are shown in Table 2.

$S_B$ in Table 1 is a sensitivity of the light-sensitive layer of the B surface. $S_{B'}$ is an apparent sensitivity obtained by the images at a B surface side obtained by removing the light-sensitive layer at an A surface side from Sample (I) described above.

Accordingly, $S_b/S_B$ corresponds to a ratio of an amount of a light transmitted through the light-sensitive layer of the A surface and the support and reaching to the B surface to an amount of a light incident on the A surface when exposure is effected from an A surface side.

TABLE 1

| Sample No. | Constitution rate of high sensitivity emulsion layer | Constitution rate of low sensitivity emulsion layer | Amount of silver attached to high sensitivity layer ($g/m^2$) | Amount of silver attached to low sensitivity layer ($g/m^2$) | Exposure method | ($S_{B'}/S_B$) |
|---|---|---|---|---|---|---|
| 1 | ①-3: 20%<br>①-1: 30%<br>①-2: 50% | ①-3: 20%<br>①-1: 30%<br>①-2: 50% | 2.15 | 2.15 | Both surface* | 0.32 |
| 2 | ①-3: 15%<br>②: 85% | ①-3: 15%<br>②: 85% | 1.55 | 1.55 | Both surface* | 0.25 |
| 3 | ①-3: 10%<br>①-4: 90% | ①-2: 50%<br>①-1: 50% | 3.25 | 1.51 | Single back** | 0.40 |
| 4 | ①-3: 15%<br>①-4: 85% | ①-2: 45%<br>①-1: 55% | 3.30 | 1.47 | Single back** | 0.42 |
| 5 | ①-4: 30%<br>①-2: 70% | ①-2: 85%<br>①-1: 15% | 2.33 | 1.97 | Single back** | 0.43 |
| 6 | ①-3: 15%<br>①-4: 85% | ①-2: 45%<br>①-1: 55% | 2.20 | 2.10 | Single back** | 0.53 |
| 7 | ①-3: 60%<br>②: 40% | ①-1: 10%<br>②: 90% | 3.10 | 2.00 | Single back** | 0.23 |
| 8 | ①-3: 25%<br>②: 75% | ②: 100% | 2.30 | 2.00 | Single back** | 0.20 |
| 9 | ①-3: 10%<br>①-4: 90% | ①-2: 50%<br>①-1: 50% | 3.25 | 1.51 | Single back** | 0.34 |
| 10 | ①-3: 15%<br>①-4: 85% | ①-2: 45%<br>①-1: 55% | 3.30 | 1.47 | Single back** | 0.35 |

*Both surface: Conventional exposure method using a X-ray fluorescent intensifying screen on both surfaces of a film
**Single back: Exposure method using a fluorescent screen on one surface of a film

TABLE 2

| Sample No. | High sensitivity Emulsion: Relative sensitivity | High sensitivity Emulsion: Maximum sensitivity | Low sensitivity Emulsion: Relative sensitivity | Low sensitivity Emulsion: Maximum sensitivity | Sensitivity | Gamma | Evaluation of sharpness | Remarks |
|---|---|---|---|---|---|---|---|---|
| 1 | 100 | 1.72 | 100 | 1.72 | 100 | 2.9 | E | Comparative |
| 2 | 83 | 2.10 | 83 | 2.11 | 78 | 2.8 | D | Comparative |
| 3 | 250 | 1.60 | 68 | 1.65 | 101 | 2.8 | C | Comparative |
| 4 | 258 | 1.60 | 64 | 1.65 | 103 | 2.6 | D | Comparative |
| 5 | 151 | 1.62 | 104 | 1.60 | 88 | 3.1 | C | Comparative |
| 6 | 260 | 1.15 | 63 | 2.05 | 96 | 2.1 | D | Comparative |
| 7 | 235 | 2.60 | 87 | 3.01 | 92 | 2.4 | B | Present invention |
| 8 | 126 | 2.92 | 79 | 3.11 | 68 | 2.5 | A | Present invention |
| 9 | 253 | 1.85 | 68 | 1.65 | 100 | 3.1 | A | Present invention |
| 10 | 260 | 1.85 | 64 | 1.65 | 102 | 2.9 | A | Present invention |

As shown in Table 2, in Samples No. 7, No. 8, No. 9 and No. 10 of the present invention, high sensitivity could be obtained even in one surface photography, and sharpness was excellent. In Sample No. 5, when the high sensitivity emulsion layer was fog density +1.60, the low sensitivity emulsion layer took fog density +0.20 or higher so that sharpness was not so good.

EXAMPLE 2

By using the silver halide grains prepared in Example 1, a medical imaging film for CRT (cathode ray tube) photography was prepared.

The constitutions of the emulsions used and the amounts of gelatin attached to the emulsion layers are shown in Table 3.

The emulsion additive, the protective film recipe, the support to be used and the drying condition were the same as in Example 1. Further, the developing procedures were the same as in Example 1.

Backing dyes shown below were added to both layers of the emulsion layer and the protective layer at a low sensitivity emulsion layer side so as to be contained in amounts shown below.

By using Konica Medical Imaging Camera M.M. (trade name) (CRT fluorescent substance No. P.45), Samples No. 9 to No. 12 prepared were subjected to exposure of a gray scale at a shutter speed of 1 second to obtain a relative resitivity.

Backing dye A

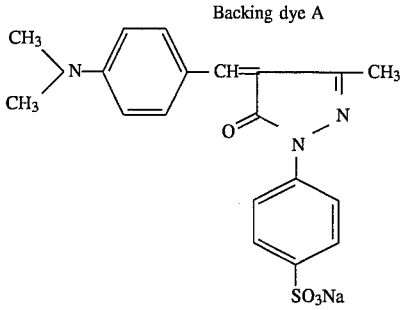

Emulsion layer 50 mg/m$^2$
Protective layer 20 mg/m$^2$

A test of drying characteristics was conducted by processing the samples in a 45 second processing mode by using an automatic developer SRX-501 (trade name, manufactured by KONICA CORPORATION). A temperature and a relative humidity at the place where the automatic developer was set were 25° C. and 62%, respectively. A temperature of a drying air of the automatic developer was set at 43° C.

In the evaluation of drying characteristics, for confirming actual drying characteristics, a processing machine and a processing agent were used under the same conditions as in the above measurement of sensitivity.

The drying characteristics were evaluated according to the following standards, and the results were divided into 5 ranks.

| Evaluation standards of drying characteristics | |
|---|---|
| 1. The sample is completely dried and warm | A |

-continued

| Evaluation standards of drying characteristics | |
|---|---|
| 2. The sample is completely dried and cold | B |
| 3. 1/3 or less of the sample is slightly wet | C |
| 4. 2/3 or less of the sample is wet | D |
| 5. More than 2/3 of the sample is wet | E |

The above evaluation results are shown in Table 4. Since a drying degree at the respective sample sides was required to be observed, the evaluation of drying characteristics was made under the same conditions as in the above water absorption measurement, but the evaluation results obtained are correlated to the results obtained by processing with an automatic developer under conventional conditions.

TABLE 3

| Sample No. | Constitution rate of high sensitivity emulsion layer | Constitution rate of low sensitivity emulsion layer | Amounts of silver and gelatin attached to high sensitivity layer (g/m$^2$) | Amounts of silver and gelatin attached to low sensitivity layer (g/m$^2$) | ($S_B$./$S_B$) |
|---|---|---|---|---|---|
| 9 | ①-2: 85%<br>①-1: 15% | — | 3.95/2.10 | 0/2.22 | — |
| 10 | ①-2: 15%<br>①-1: 85% | — | 2.75/2.10 | 0/2.22 | — |
| 11 | ①-2: 100% | ①-1: 100% | 3.20/2.10 | 0.70/2.22 | 28 |
| 12 | ①-2: 25%<br>①-1: 75% | ①-1: 100% | 2.50/2.10 | 0.60/2.22 | 18 |

TABLE 4

| Sample No. | High sensitivity emulsion: Relative sensitivity | High sensitivity emulsion: Maximum sensitivity | Low sensitivity emulsion: Relative sensitivity | Low sensitivity emulsion: Maximum sensitivity | Sensitivity | Gamma | Evaluation of drying characteristics | Remarks |
|---|---|---|---|---|---|---|---|---|
| 9 | 100 | 3.10 | — | — | 100 | 2.8 | E | Comparative |
| 10 | 50 | 3.14 | — | — | 50 | 2.9 | A | Comparative |
| 11 | 104 | 2.78 | 23 | 0.88 | 104 | 2.8 | B | Present invention |
| 12 | 66 | 2.72 | 20 | 0.78 | 66 | 2.8 | A | Present invention |

As shown in Table 4, the light-sensitive materials No. 11 and No. 12 of the present invention had high sensitivity, high sharpness and also good drying characteristics.

As the result of measurement of residual silver and residual hypo of the samples developed, it was found that the amounts of residual silver and residual hypo in Sample No. 11 of the present invention were smaller than those in Sample No. 9 for comparison, and those in Sample No. 12 of the present invention were smaller than those in Sample No. 10 for comparison, whereby good storage stability can be expected.

EXAMPLE 3

By using the silver halide emulsions prepared in Example 1, the emulsions were prepared by mixing as shown in Table 5, and a coating solution was prepared according to entirely the same manner as in Example 1 to prepare film samples shown in Table 6.

For the samples obtained, development processing is carried out in the same manner as in Example 1 in a 45 second mode.

FIG. 4 to FIG. 11 show characteristic curves of the samples of the present Example. The characteristic curves of the high sensitivity emulsion layers in the Figures were obtained by measuring images only on the high sensitivity emulsion layers obtained by removing the rear surface (low sensitivity) emulsion layers by proteinase from the samples developed by exposing from a high sensitivity emulsion layer side.

The characteristic curves of the low sensitivity emulsion layers were obtained by measuring images only on the low sensitivity emulsion layers obtained by removing the rear surface (high sensitivity) emulsion layers by proteinase from the samples developed by exposing from a high sensitivity emulsion layer side.

The sensitivity values in Table 6 were determined as a reciprocal of an X-ray dosage necessary for obtaining a density of 1.0, and are represented in a relative sensitivity when the sensitivity of Sample No. 1 was defined as 100. Sample No. 1 was subjected to a conventional exposure by using a X-ray fluorescent intensifying screen on both surfaces since Sample No. 1 had the same emulsion constituent layer as a conventional X-ray film of both surface type.

In Table 6, the gamma values are represented in a reciprocal of a difference between reciprocals of logarithms of X-ray dosages giving densities of (fog+0.70) and (fog+1.20).

As clearly seen from Table 6, it can be understood that although in the samples according to the present invention, sharpness was excellent without lowering in sensitivity, in comparative examples, for example, Sample No. 8, sharpness was good, but sensitivity was extremely lowered.

TABLE 5

| Sample No. | Constitution rate of high sensitivity emulsion layer | Constitution rate of low sensitivity emulsion layer | Amount of silver attached to high sensitivity layer ($g/m^2$) | Amount of silver attached to low sensitivity layer ($g/m^2$) | Exposure method |
|---|---|---|---|---|---|
| 1 | ①-3: 20%<br>①-1: 20%<br>①-2: 60% | ①-3: 20%<br>①-1: 20%<br>①-2: 60% | 2.20 | 2.20 | Both surface* |
| 2 | ①-3: 25%<br>①-2: 20%<br>①-4: 55% | ①-2: 60%<br>②: 40% | 3.65 | 1.40 | Single back** |
| 3 | ①-3: 15%<br>①-2: 15%<br>①-4: 70% | ①-2: 50%<br>②: 50% | 3.60 | 1.70 | Single back** |
| 4 | ①-3: 25%<br>①-2: 20%<br>①-4: 55% | ①-1: 70%<br>①-2: 30% | 3.65 | 1.00 | Single back** |
| 5 | ①-3: 15%<br>①-2: 15%<br>①-4: 70% | ①-2: 60%<br>①-1: 40%<br>①-1: 40% | 3.60 | 1.40 | Single back** |
| 6 | ①-3: 20%<br>②: 80 | ①-2: 60%<br>①-1: 40% | 2.90 | 1.40 | Single back** |
| 7 | ①-3: 20<br>②: 80% | ①-2: 60%<br>①-1: 40% | 3.40 | 1.40 | Single back** |
| 8 | ①-3: 20%<br>②: 80% | None | 4.05 | 0 | Single back** |

*Both surface: Conventional exposure method using a X-ray fluorescent intensifying screen on both surfaces of a film
**Single back: Exposure method using a fluorescent screen on one surface of a film

TABLE 6

| Sample No. | Maximum density (not including support density) High sensitivity surface | Maximum density (not including support density) Low sensitivity surface | Maximum density of high sensitivity surface + low sensitivity surface (including support density) | Density of low sensitivity surface when density of high sensitivity surface is fog density + 1.60 - Fog density | Amount of light transmitted from high sensitivity surface to low sensitivity surface (%) | System sensitivity | Fog | Gamma | Sharpness | Remarks |
|---|---|---|---|---|---|---|---|---|---|---|
| 1 | 1.60 | 1.60 | 3.35 | — | 31 | 100 | 0.18 | 2.50 | E | Comparative |
| 2 | 2.00 | 1.30 | 3.45 | 0.26 | 23 | 100 | 0.18 | 1.80 | D | Comparative |
| 3 | 2.00 | 1.28 | 3.43 | 0.31 | 21 | 100 | 0.17 | 2.50 | D | Comparative |
| 4 | 2.00 | 1.02 | 3.17 | 0.16 | 23 | 100 | 0.18 | 1.80 | A | Present invention |
| 5 | 2.00 | 1.30 | 3.45 | 0.05 | 21 | 100 | 0.17 | 2.50 | A | Present invention |
| 6 | 1.87 | 1.30 | 3.32 | 0.22 | 24 | 90 | 0.17 | 2.20 | D | Comparative |
| 7 | 2.21 | 1.30 | 3.66 | 0.18 | 18 | 100 | 0.17 | 2.50 | B | Present invention |
| 8 | 3.25 | — | 3.40 | — | — | 55 | 0.18 | 2.40 | A | Comparative |

EXAMPLE 4

By using the silver halide grains prepared in Example 1, samples having the constitutions shown in Table 7 were prepared according to entirely the same manner as in Example 2.

For the samples obtained, the results obtained by testing sensitometry, sharpness and drying characteristics are shown in Table 8.

As clearly seen from Table 8, all of sensitivity, sharpness and drying characteristics were good.

TABLE 7

| Sample No. | Constitution rate of high sensitivity emulsion layer | Constitution rate of low sensitivity emulsion layer | Amount of silver and gelatin attached to high sensitivity layer (g/m²) | Amount of silver and gelatin attached to low sensitivity layer (g/m²) |
|---|---|---|---|---|
| 9 | ①-2: 80%<br>①-1: 20% | — | 3.80/2.30 | 0/2.20 |
| 10 | ①-2: 90%<br>①-4: 10% | ①-2: 30%<br>①-1: 70% | 2.90/2.30 | 1.10/2.20 |
| 11 | ①-2: 90%<br>①-4: 10% | ①-2: 10%<br>①-1: 90% | 2.90/2.30 | 1.10/2.20 |
| 12 | ①-2: 90%<br>①-4: 10% | ①-1: 100% | 2.90/2.30 | 1.10/2.20 |

After adjusting pH=9 and pAg=9.0 with acetic acid and silver bromide, an ammoniacal silver ion solution and potassium bromide were added simultaneously to effect growing, followed by further growing until reaching to 90% of a grain size. At this time, the pH was lowered gradually from 9.0 to 8.20.

After adjusting a pAg to 11 with addition of a potassium bromide solution, further an ammoniacal silver ion solution and potassium bromide were added to effect growing while lowering the pH gradually to 8, thereby obtaining a monodispersed silver iodobromide emulsion having an average grain size of 0.7 μm, a shape of roundish cube and variation coefficient of 0.15 and containing 2 mole % of silver iodide.

During preparation of the emulsion, the above sensitizing dye (A) and sensitizing dye (B) were added in amounts of 300 mg and 15 mg, respectively, per mole of silver in the emulsion.

The emulsion obtained was maintained at 40° C., and an appropriate amount of a formalin resin of sodium naphthalenesulfonate (average polymerization degree: 4 to 6) was added therein to sediment silver halide grains. After removal of a supernatant, pure water at a temperature of 40° C. was added, and then magnesium sulfate was added to sediment silver halide grains again, followed by removal of a supernatant.

After this procedure was repeated, gelatin was added to obtain an emulsion having pH=6.0 and pAg=8.5.

To the emulsion obtained, ammonium thiocyanate, chloroauric acid and hypo were added, and chemical ripening was effected under the conditions so as to obtain a maximum density.

Subsequently, an appropriate amount of 4-hydroxy-6-methyl1,3,3*a*,7-tetrazaindene was added as a stabilizer to obtain an emulsion. This emulsion was called (A-1).

Further, similarly as in (A-1), an emulsion with a grain size of 0.4 μm was prepared, and this was called (A-2).

(B) Preparation of tabular grain emulsion

In 1 liter of water, 10.5 g of potassium bromide, 10 ml of 0.5% by weight of an aqueous solution of $HO(CH_2)_2S(CH_2)_2S(CH_2)_2OH$ which is a thioether compound and 30 g of gelatin were added and dissolved, and the solution was maintained at 70° C. To this solution, under stirring, 30 ml of a 0.88 mole/l aqueous silver nitrate solution and 30 ml of a 0.88 mole/l aqueous solution of potassium iodide and potassium bromide (molar ratio; 3.5:96.5) were added according to a double jet method to obtain grains having an average grain size of 0.68 μm and a silver iodide content of 3.5 mole %.

After completion of the addition of said mixed solution, a temperature was lowered to 40° C. To this solution were added 24.6 g/AgX mole of a resin of formalin and sodium

TABLE 8

| Sample No. | Maximum density (not including support density) High sensitivity surface | Low sensitivity surface | Maximum density of high sensitivity surface + low sensitivity surface (including support density) | Density of low sensitivity surface when density of high sensitivity surface is fog density + 1.60 - Fog density | Amount of light transmitted from high sensitivity surface to low sensitivity surface (%) | System sensitivity | Fog | Gamma | Sharpness | Drying characteristics | Remarks |
|---|---|---|---|---|---|---|---|---|---|---|---|
| 9 | 3.05 | — | 3.20 | — | — | 100 | 0.17 | 2.35 | A | E | Comparative |
| 10 | 1.98 | 1.04 | 3.17 | 0.21 | 28 | 128 | 0.17 | 2.30 | D | A | Comparative |
| 11 | 1.98 | 1.11 | 3.24 | 0.18 | 28 | 128 | 0.17 | 2.30 | B | A | Present invention |
| 12 | 1.98 | 1.16 | 3.29 | 0.08 | 28 | 128 | 0.17 | 2.30 | A | A | Present invention |

EXAMPLE 5

(A) Preparation of monodispersed emulsion

Under the conditions of a reaction vessel of 60° C. and pAg=8, while maintaining pH 2, a monodispersed cubic system emulsion having an average grain size of 0.3 μm, a cubic shape and variation coefficient of 0.14 and containing 2 mole % of silver iodide was obtained according to a double jet method. According to observation with an electron microscope, generation rate of twins was 1% or less in number.

This emulsion was used as a seed grain, and grown in the following manner.

In a reaction vessel, the above seed crystals were dissolved in an aqueous gelatin solution maintained at 40° C., and to the mixture were added aqueous ammonia and acetic acid to adjust a pH to 9.5.

After adjusting a pAg to 7.3 with an ammoniacal silver ion solution, while maintaining pH and pAg constantly, ammoniacal silver ions and a solution containing potassium iodide and potassium bromide were added according to a double jet method to give a silver iodobromide emulsion containing 30 mole % of silver iodide.

naphthalenesulfonate, and magnesium sulfate, respectively, followed by lowering pH to 4.0 and desalting. Thereafter, 15 g/AgX mole of gelatin was added to prepare a tabular grain emulsion.

The emulsion obtained in the above (B) was chemically sensitized. Specifically, ammonium thiocyanate, chloroauric acid and hypo were added to effect gold-sulfur sensitization.

After completion of this chemical sensitization, 4-hydroxy-6-methyl-1,3,3*a*,7-tetrazaindene was added. Subsequently, by adding 150 mg/mole of AgX potassium iodide and the same amounts of the above sensitizing dyes (A) and (B) as in the Case of Emulsion (A-1), spectral sensitization was effected. The emulsion obtained was called Emulsion (B).

Additives used in the respective emulsion solutions (light-sensitive silver halide coating solutions) of (A-1), (A-2) and (B) are shown below. The amounts added are represented in an amount per mole of silver halide.

| | |
|---|---|
| 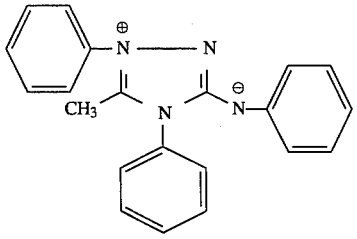 | 150 mg |
| t-Butyl-catechol | 400 mg |
| Polyvinyl pyrrolidone (Mw: 10,000) | 1.0 g |
| Styrene-maleic anhydride copolymer | 2.5 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 1.5 mg |
| 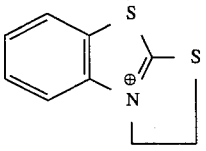 | 70 mg |
| $n\text{-}C_4H_9OCH_2CH(OH)CH_2N(CH_2COOH)_2$ | 1 g |

The additives used in the protective layer solution are shown below. The amounts added are represented in an amount per gram of gelatin.

| | |
|---|---|
| Silicon dioxide grain, a matte agent comprising polymethyl methacrylate with an average grain size per unit area or 7 μm | 7 mg |
| Colloidal silica (average grain size: 0.013 μm) | 70 mg |
| 2,4-Dichloro-6-hydroxy-1,3,5-triazine sodium salt | 30 mg |
| $(CH_{2CHSO_2}-CH_2)_2-O$ | 36 mg |
| 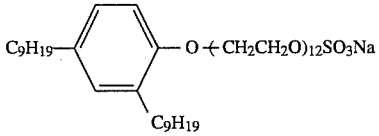 | 12 mg |

-continued

| | |
|---|---|
| 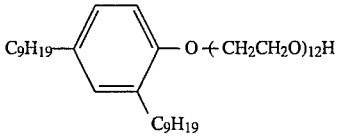 | 2 mg |
| $CH_2COO(CH_2)_9CH_3$<br>$CHCOO(CH_2)_2CH(CH_3)_2$<br>$SO_3Na$ | 7 mg |
| 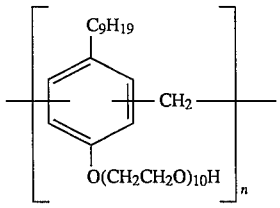 <br>(mixtiure wherein n is 2 to 5) | 15 mg |
| $NaO_3S-CH(CH_2COOCH_2(C_2F_4)_3H)-CH_2COOCH_2(C_2F_4)_3H$ | 5 mg |
| $F_{19}C_9-O-(CH_2CH_2O)_{10}-CH_2CH_2-OH$ | 3 mg |

The above coating solutions were coated on both surface of a blue-colored polyethylene terephthalate film base with a thickness of 180 μm previously subjected to subbing treatment, followed by drying, to obtain Samples No. 1 to No. 11 shown in Table 9-1.

To the emulsion coating solutions were added exemplary compounds of the polyvalent alcohol according to the present invention, respectively, as shown in Table 9-1. The amounts coated were adjusted so as to contain amounts of gelatin and amounts of silver shown in Table 9.

On the (A surfaces) of Samples No. 1 to No. 9 was used Emulsion (A-1), and on the (A surfaces) of Samples No. 10 and No. 11 was used Emulsion (B). On all the (B surfaces) was used Emulsion (A-2).

Relative sensitivities of the respective surfaces of the samples obtained were measured in the same manner as in Example 1.

Evaluation of MTF

An MTF chart made of lead having 0.5 to 10 line/mm of square waves was brought in close contact with a rear surface at a front side of a X-ray fluorescent intensifying screen, and X-rays were irradiated so that a density of both surfaces of film portions which were not shielded by the chart made of lead became about 1.0.

After the samples irradiated with X-rays as described above were subjected to the same development processing as described above, a pattern of the square waves recorded was measured by using Sakura Microdensitometer Model M-5 (trade name, manufactured by Konica Corporation). At this time, the aperture size was 300 μm in the direction parallel to the square waves and 25 μm in the direction perpendicular to them, and a magnification was 20. The MTF values obtained are represented in a value at a spatial frequency of 2.0 line/mm The sharpness values in Table 8 were obtained by conducting photographing four extremital bone phantom obliquely at an X-ray incident angle of 30°, carrying out the same processings as described above, observing the images obtained with eyes and evaluating them by using the following 5 ranks.

1. Extremely inferior
2. Inferior
3. Average
4. Good
5. Extremely good

Evaluation of curling degree

After 3 sheets of the same film sample and a wrapping paper (natural pulp paper) were left to stand under an atmosphere of a temperature of 23° C. and a relative humidity of 50% for 10 hours to adjust humidity, 3 sheets of the sample superposed were sandwiched with the wrapping paper, and left to stand under a loading of 2 g/cm$^2$ for 48 hours.

A curling degree of the samples obtained was evaluated by using the following 5 ranks.

A: −0.50 to +0.50

B: −1.00 to −0.51 and +1.51 to +1.00

C: −1.50 to −1.01 and +1.01 to +1.50

D: −2.50 to −1.51 and +1.51 to +2.5

E: −2.51 or less and +2.51 or more

A indicates that a sample is the lowest in curling degree and the most excellent.

Evaluation of adhesion

Films were superposed to each other and sealed and packed under the same conditions. After the films were left to stand at 50° C. for 3 days under loading so as to apply a pressure of 20 g/cm$^2$ to the films, an adhesion degree between the films was evaluated by using the following 5 ranks.

A: No adhesion at all.

B: 5% or less of total area is adhered.

C: 10% or less of total area is adhered.

D: 30% or less of total area is adhered.

E: more than 30% of total area is adhered.

Evaluation of automatic conveying property

After 100 sheets of common 10×12 inch size film (divided by 50 sheets with a sandpaper) which had been prepared to be used as a sample were stored at a room temperature and an ordinary humidity, an automatic conveying test was conducted by using KD Autofeeder 500 (trade name, manufactured by Konica Corporation).

Evaluation was made by using the following 4 ranks.

A: All 100 sheets were conveyed normally.

B: All 100 sheets were conveyed normally (during conveying, troubles were caused, but recovered automatically).

C: 1 to 4 sheets of 100 sheets were not conveyed (not recovered automatically).

D: 5 or more sheets of 100 sheets were not conveyed.

The results obtained are shown in Table 9-2.

TABLE 9-1

| | High sensitivity emulsion surface (A surface) | | | | | Low sensitivity emulsion surface (B surface) | | | | |
|---|---|---|---|---|---|---|---|---|---|---|
| Sample No. | Amount of silver (g/m$^2$) | Gel amount (g/m$^2$) | Ratio of Ag/Gel* | Exemplary Compound (mmol/m$^2$) | | Amount of silver (g/m$^2$) | Gel amount (g/m$^2$) | Ratio of Ag/Gel* | Exemplary Compound (mmol/m$^2$) | |
| 1 | 3.0 | 3.4 | 0.88 | B-30 | 1.7 | 1.5 | 1.32 | 0.88 | B-30 | 0.66 |
| 2 | 3.0 | 3.4 | 0.88 | B-30 | 1.7 | 1.5 | 2.4 | 0.63 | B-30 | 1.2 |
| 3 | 3.0 | 3.4 | 0.88 | B-30 | 1.7 | 1.5 | 3.4 | 0.44 | Comparative-1** | 1.7 |
| 4 | 3.0 | 3.4 | 0.88 | Comparative-1** | 1.7 | 1.5 | 3.4 | 0.44 | B-30 | 1.7 |
| 5 | 3.0 | 3.4 | 0.88 | B-30 | 1.8 | 1.5 | 3.4 | 0.44 | B-30 | 1.8 |
| 6 | 3.0 | 3.4 | 0.88 | B-1 | 1.7 | 1.5 | 3.4 | 0.44 | B-1 | 1.7 |
| 7 | 3.0 | 3.4 | 0.88 | B-19 | 1.7 | 1.5 | 3.4 | 0.44 | B-19 | 1.7 |
| 8 | 3.0 | 3.4 | 0.88 | B-40 | 1.7 | 1.5 | 3.4 | 0.44 | B-40 | 1.7 |
| 9 | 3.6 | 3.4 | 1.06 | B-30 | 2.0 | 2.0 | 3.4 | 0.59 | B-30 | 1.7 |
| 10 | 2.6 | 3.4 | 0.76 | B-30 | 1.0 | 2.0 | 3.4 | 0.36 | B-30 | 1.0 |
| 11 | 2.2 | 6.1 | 0.36 | B-30 | 1.0 | 1.2 | 3.4 | 0.29 | B-30 | 0.5 |

*Gel: Gelatin

**Comparative-1: diethylene glycol, melting point: −6.5° C.

TABLE 9-2

| Sample No. | Relative sensitivity A surface | Relative sensitivity B surface | System sensitivity | MTF (2LP/mm) | Sharpness | Curling degree | Adhesion | Automatic conveying property | Remarks |
|---|---|---|---|---|---|---|---|---|---|
| 1 | 100 | 32 | 100 | 0.73 | 5 | D | A | D | Present invention |
| 2 | 100 | 32 | 100 | 0.73 | 5 | B | A | B | Present invention |
| 3 | 100 | 32 | 100 | 0.73 | 5 | A | A | A | Present invention |
| 4 | 96 | 30 | 96 | 0.74 | 5 | B* | A | C** | Present invention |
| 5 | 100 | 32 | 100 | 0.73 | 5 | A | D | D | Present invention |
| 6 | 100 | 32 | 98 | 0.73 | 5 | A | A | A | Present invention |

TABLE 9-2-continued

| Sample No. | Relative sensitivity A surface | Relative sensitivity B surface | System sensitivity | MTF (2LP/mm) | Sharpness | Curling degree | Adhesion | Automatic conveying property | Remarks |
|---|---|---|---|---|---|---|---|---|---|
| 7 | 98 | 32 | 100 | 0.74 | 5 | A | A | A | Present invention |
| 8 | 100 | 32 | 100 | 0.73 | 5 | A | A | A | Present invention |
| 9 | 106 | 36 | 106 | 0.74 | 5 | A | A | A | Present invention |
| 10 | 106 | 34 | 106 | 0.71 | 5 | A | A | A | Present invention |
| 11 | 100 | 32 | 100 | 0.70 | 5 | A | A | A | Present invention |

Note)
B*: 1st and 50th sheets of 50 sheets of films superposed had a curling degree of +1.5 or more.
C**: Conveying failure occurred in 1st and 50th sheets.

As shown in Tables 9-1 and 9-2, in the samples of the present invention, the curling degree was low, and the films were not adhered to each other, whereby no trouble was caused during automatic conveying.

Further, the images obtained were excellent in sharpness and had high sensitivity.

With respect to Samples No. 4 and No. 5, automatic conveying property was slightly bad.

EXAMPLE 6

Using the film of Sample No. 7 prepared in Example 5, 10×12 inch size films (25.4 cm in length×30.5 cm in width) cut a part of left end portions as shown in FIG. 1(*a*), FIG. 3(*b*), (*c*) or (*d*) were prepared to use for films for single face direct X-ray photographing of the comparative purpose and the present invention. On the other hand, as cassettes for these films, (a'), (b'), (c') and (d') corresponding to them, respectively, were prepared. Using the four kinds of films and cassettes thus obtained, X-ray fluorescent intensifying screens were each placed therebetween and loaded in the cassettes in a dark room. Then, X-ray exposure was carried out through an aluminum wedge at a tube voltage of 90 KVP and a tube current of 100 mA and the films were each developed by using an automatic processor SRX-501 and XD-SR and XF-SR processing solutions (each produced by KONICA CORPORATION).

As the results, in the 10×12 inch size films shown in FIGS. 3(*b*), (*c*) and (*d*) according to the method of the present invention, it is not necessary to judge the right side and the wrong side of the film when subjecting to load of the film in a dark room since the shape of edge of the film had been accorded with that of the film cassette, and loading is easy as compared with that of the film (a) shown in FIG. 1(*a*) as well as no wrong loading was caused.

EXAMPLE 7

By using the silver halide emulsion prepared in Example 1, emulsions were prepared by mixing as shown in Table 10, and a coating solution was prepared according to entirely the same manner as in Example 1 to prepare film samples as shown in Table 11.

For the samples obtained, processing were carried out in the following conditions.

(Automatic processor)

Processing is carried out by using SRX 501 (trade name, produced by KONICA CORPORATION) with 45 seconds processing mode. A temperature of the developing processing solution is 35° C. and that of the fixing solution is 33° C. Also, water for washing is supplied with 4 liters per minute and a water temperature of 18° C. A drying temperature is 45° C. Atmosphere in which the automatic processor is installed is 25° C. and 60% relative humidity.

| (Developing solution recipe) | |
|---|---|
| Part - A (for 38 liters finishing) | |
| Potassium hydroxide | 1140 g |
| Potassium sulfite | 2280 g |
| Sodium hydrogen carbonate | 266 g |
| Boric acid | 38 g |
| Diethylene glycol | 418 g |
| Ethylenediaminetetraacetic acid | 61 g |
| 5-Methylbenzotriazole | 1.9 g |
| Hydroquinone | 1064 g |
| Made up to 9.3 liters with addition of water. | |
| Part B (for 38 liters finishing) | |
| Glacial acetic acid | 418 g |
| Triethylene glycol | 418 g |
| 1-Phenyl-3-pyrazolidone | 100 g |
| 5-Nitroindazole | 9.5 g |
| Made up to one liter with addition of water. | |
| Part - C (for 38 liters finishing) | |
| Glutaraldehyde (50 wt/wt %) | 304 g |
| Sodium metabisulfite | 389 g |
| Made up to 770 ml with addition of water. | |
| Starter | |
| Glacial acetic acid | 230 g |
| Potassium bromide | 200 g |
| Made up to 1.5 liters with addition of water. | |

(Developing solution preparing method)

In a replenishing solution stock tank is charged 20 liters of water with a water temperature of 18° C. and under stirring, the above Part-A, Part-B and Part-C are successively added thereinto to make 38 liters of a solution having a pH of 10.53 at 25° C. After allowing this developing replenishing solution to stand at 25° C. for 24 hours, the above starter is added to the solution with an amount of 20 ml per liter and the mixture is filled in a developing tank of the automatic processor available from KONICA CORPORATION. A pH of the developing solution at this time is 10.26 at 25° C.

The developing replenishing solution was replenished with an amount of 365 ml per 1 $m^2$ of a sample of the present invention.

| (Fixing solution recipe) | |
|---|---|
| Part - A (for 38 liters finishing) | |
| Ammonium thiosulfate | 6080 g |
| Disodium ethylenediaminetetraacetate dihydrate | 0.76 g |
| Sodium sulfite | 456 g |
| Boric acid | 266 g |
| Sodium hydroxide | 190 g |
| Glacial acetic acid | 380 g |
| Made up to 9.5 liters with addition of water. | |
| Part - B (for 38 liters finishing) | |
| Aluminum sulfate (in terms of anhydride) | 570 g |
| Sulfuric acid (50 wt %) | 228 g |
| Made up to 1.9 liters with addition of water. | |

(Fixing solution preparing method)

In a replenishing solution stock tank is charged 20 liters of water with a water temperature of 18° C. and under stirring, the above Part-A and Part-B are successively added thereinto. Finally, water and acetic acid are added to make 38 liters of a solution having a pH of 4.20 at 25° C. After allowing this fixing replenishing solution to stand at 25° C. for 24 hours, it is filled in a fixing tank of the automatic processor available from KONICA CORPORATION. A replenishing amount of the fixing replenishing solution is 640 ml per 1 $m^2$ of a sample of the present invention.

TABLE 10

| Sample No. | Constitution rate of high sensitivity emulsion layer | Constitution rate of low sensitivity emulsion layer | Amount of silver attached to high sensitivity layer ($g/m^2$) | Amount of silver attached to low sensitivity layer ($g/m^2$) | Exposure method |
|---|---|---|---|---|---|
| 1 | ①-3: 20%<br>①-1: 20%<br>①-2: 60% | ①-3: 20%<br>①-1: 20%<br>①-2: 60% | 2.20 | 2.20 | Both surface* |
| 2 | ①-3: 25%<br>①-2: 20%<br>①-4: 55% | ①-2: 60%<br>②: 40% | 3.65 | 1.40 | Single back** |
| 3 | ①-3: 15%<br>①-2: 15%<br>①-4: 70% | ①-2: 50%<br>②: 50% | 3.60 | 1.70 | Single back** |
| 4 | ①-3: 25%<br>①-2: 20%<br>①-4: 55% | ①-1: 70%<br>①-2: 30% | 3.65 | 1.00 | Single back** |
| 5 | ①-3: 15%<br>①-2: 15%<br>①-4: 70% | ①-2: 60%<br>①-1: 40% | 3.60 | 1.40 | Single back** |
| 6 | ①-3: 20%<br>②: 80% | ①-2: 60%<br>①-1: 40% | 3.40 | 1.40 | Single back** |

*Both surface: Conventional exposure method using a X-ray fluorescent intensifying screen on both surfaces of a film
**Single back: Exposure method using a fluorescent screen on one surface of a film The results are shown in Table 11.

TABLE 11

| Sample No. | Maximum density (not including support density) High sensitivity surface | Maximum density (not including support density) Low sensitivity surface | Maximum density of high sensitivity surface + low sensitivity surface (including support density) | Density of low sensitivity surface when density of high sensitivity surface is fog density + 1.60 - Fog density | Amount of light transmitted from high sensitivity surface to low sensitivity surface (%) | System sensitivity | Fog | Gamma | Sharpness | Remarks |
|---|---|---|---|---|---|---|---|---|---|---|
| 1 | 1.63 | 1.63 | 3.41 | — | 31 | 100 | 0.18 | 2.55 | E | Comparative |
| 2 | 2.05 | 1.33 | 3.53 | 0.27 | 23 | 100 | 0.18 | 1.87 | D | Comparative |
| 3 | 2.04 | 1.30 | 3.44 | 0.33 | 21 | 100 | 0.17 | 2.55 | D | Comparative |
| 4 | 2.05 | 1.04 | 3.24 | 0.16 | 23 | 100 | 0.17 | 1.90 | A | This invention |
| 5 | 2.04 | 1.33 | 3.52 | 0.06 | 21 | 100 | 0.17 | 2.55 | A | This invention |
| 6 | 2.25 | 1.32 | 3.72 | 0.18 | 18 | 100 | 0.17 | 2.55 | B | This invention |

A can be seen from the results shown in Table 11, samples according to the present invention showed excellent sharpness as in Example 3.

According to the present invention, a light-sensitive silver halide photographic material having high sensitivity and high sharpness, and also improved in automatic conveying property could be obtained.

Further, according to the present invention, there could be obtained a light-sensitive silver halide photographic material and a method for photography of the same wherein images having high sharpness can be obtained by using a X-ray fluorescent intensifying screen only on one surface and effecting exposure only from one surface. Furthermore, according to the present invention, there could be obtained a method for X-ray photography which can facilitate distinction between a front surface and a rear surface of a film and prevent erroneous loading when a film is inserted into a cassette.

We claim:

1. A method of forming an image on a light-sensitive silver halide photographic material comprising a transparent support having a first face and a second face, a first component layer on said first face and a second component layer on said second face, said first component layer comprising a first silver halide emulsion layer and said second component layer comprising a second silver halide emulsion layer, said method comprising exposure with not more than one intensifying screen, at a first position on said first component layer to light of wavelength of at least 300 nm and development of said material, an exposure dose of said light on said first component layer providing a density of fog density +1.60 after said exposure and said development, said dose also providing, at a second position on said second component layer corresponding to said first position, a density of fog density +0.20 or less, after said exposure and said development, and an amount of said light which is transmitted through said first component layer and said support and reaching an interface between said support and said second component layer is 12% to 75% of said light.

2. The method of claim 1 wherein said first emulsion layer has a sensitivity higher than that of said second emulsion layer.

3. The method of claim 2 wherein a sensitivity of said first emulsion layer is 1.5 to 10 times a sensitivity of said second emulsion layer.

4. The method of claim 3 wherein a first value which is a weight ratio of silver to gelatin of said first emulsion layer is larger than a second value which is a weight ratio of silver to gelatin of said second emulsion layer.

5. The method of claim 4 wherein said first component layer and said second component layer comprise a polyvalent alcohol compound in an amount of $5.0\times10^{-5}$ to $5\times10^{-3}$ mol per gram of said gelatin.

6. The method of claim 2 wherein an amount of silver of said emulsion layer is 1.1 to 5.0 times that of an amount of silver in said second emulsion layer.

7. The method of claim 1 wherein silver halide grains having grain sizes of 0.50 to 2.00 μm occupy at least 50% of a projected area of total silver halide grains in said first emulsion layer.

8. The method of claim 1 wherein normal crystalline monodispersed grains or twin tabular grains having an aspect ratio of at least 5 occupy at least 60% of a projected area of total silver halide grains in said first emulsion layer.

* * * * *